US011375320B2

(12) United States Patent
Semperlotti et al.

(10) Patent No.: US 11,375,320 B2
(45) Date of Patent: Jun. 28, 2022

(54) THERMOACOUSTIC DEVICE AND METHOD OF MAKING THE SAME

(71) Applicant: Purdue Research Foundation, West Lafayette, IN (US)

(72) Inventors: Fabio Semperlotti, Lafayette, IN (US); Haitian Hao, West Lafayette, IN (US); Carlo Scalo, West Lafayette, IN (US); Mihir Sen, West Lafayette, IN (US)

(73) Assignees: Purdue Research Foundation, West Lafayette, IN (US); Notre Dame Du Lac, South Bend, IN (US)

( * ) Notice: Subject to any disclaimer, the term of this patent is extended or adjusted under 35 U.S.C. 154(b) by 0 days.

(21) Appl. No.: 16/556,228

(22) Filed: Aug. 30, 2019

(65) Prior Publication Data

US 2020/0092660 A1 Mar. 19, 2020

Related U.S. Application Data

(60) Provisional application No. 62/725,258, filed on Aug. 30, 2018.

(51) Int. Cl.

| | |
|---|---|
| ***F25B 21/00*** | (2006.01) |
| ***H04R 23/00*** | (2006.01) |
| ***F25B 21/02*** | (2006.01) |
| ***H05B 1/02*** | (2006.01) |

(52) U.S. Cl.

CPC ..... *H04R 23/002* (2013.01); *F25B 21/02* (2013.01); *H05B 1/0294* (2013.01)

(58) Field of Classification Search

CPC ..... H04R 23/002; H05B 1/0294; F25B 21/02

USPC ..... 62/1

See application file for complete search history.

(56) References Cited

U.S. PATENT DOCUMENTS

2005/0068736 A1* 3/2005 Moroz ..... H01L 21/67109 361/704

2007/0224777 A1* 9/2007 Hamelin ..... C23C 16/4586 438/457

OTHER PUBLICATIONS

Hao, Haitian et al., Traveling and standing thermoacoustic waves in solid media, Journal of Sound and Vibration, 449 (2019) pp. 30-42.

Hao, Haitian et al., Thermoacoustics of solids: A pathway to solid state engines and refrigerators, Journal of Applied Physics, 123, 024903 (2018).

Swift, G.W., Thermoacoustic Engines, J. Acoust. Soc. Am. 84 (4), Oct. 1988; pp. 1145-1180.

Jin, T., et al., Application of thermoacoustic effect to refrigeration, Review of Scientific Instruments, vol. 74, No. 1, Jan. 2003, © 2003 American Institute of Physics; pp. 677-679.

Garrett, Steven L., et al., Thermoacoustic Refrigertor for Space Applications, Journal of Thermophysics and Heat Tranfer, vol. 7, No. 4, Oct.-Dec. 1993; pp. 595-599.

(Continued)

*Primary Examiner* — Davis D Hwu

(74) *Attorney, Agent, or Firm* — Purdue Research Foundation

(57) ABSTRACT

A thermoacoustic device includes a stage coupled to a bar, wherein the stage includes a first heating component on a first terminus of the stage. The stage further includes a first cooling component on a second terminus of the stage. A thermal conductivity of the stage is higher than a thermal conductivity of the bar. A heat capacity of the stage is higher than a heat capacity of the bar.

19 Claims, 8 Drawing Sheets

(56) References Cited

OTHER PUBLICATIONS

Lin, Jeffrey et al., High-fidelity simulation of a standing-wave thrmoacoustic-piezoelectric engine, J. Fluid Mech. (2016), vol. 808, pp. 19-60. © 2016 Cambridge University Press.
Garrett, Steven L. et al., 4aPA2. Thermoacoustic life sciences refrigerator, Physical Coustics: Acoustics in Space, 125th Meeting: Acoustical Society of America, J. Acoust. Soc. Am., vol. 93, No. 4, Pt. 2, Apr. 1193; p. 2364.
Yazaki, T. et al., Traveling Wave Thermoacoustic Engine in a Looped Tube, Physical Review Letters, vol. 81, No. 15, Oct. 12, 1998; pp. 3128-3131.
Ceperley, Peter H., A pistonless Stirling engine—The traveling wave heat engine, J. Acoust. Soc. Am. 66(5), Nov. 1979, pp. 1508-1513, © 1979 Acoustical Society of America.
Backhaus, S. et al., Athermoacoustic-Stirling heat engine: Detailed study, J. Acoust. Soc. Am. 107 (6), Jun. 2000, pp. 3148-3166, © 92000 Acoustical Society of America.
Ravex, A. et al., Development of Low Frequency Pulse Tube Refrigerators, Advances in Cryogenic Engineering, vol. 43, Edited by P. Kittel, Plenum Press, New York, 1998; pp. 1957-1964.
Swift, G.W., Analysis and performance of a large thermoacoustic engine, J. Acoust. Soc. Am. 92 (3), Sep. 1992, pp. 1551-1563, © 1992 Acoustical Society of America.

* cited by examiner

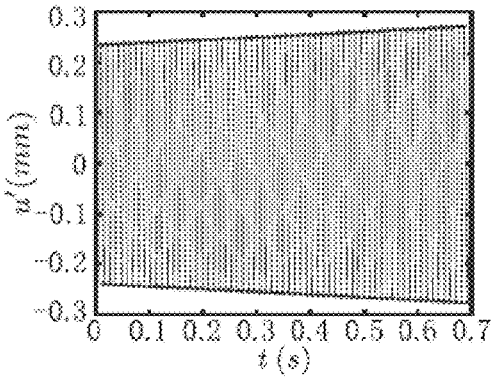
Fig. 2(d)
| | Theory | COMSOL | Error |
|---|---|---|---|
| $\beta(s^{-1})$ | 0.210 | 0.212 | 1% |
| $\omega(rad/s)$ | 585.5 | 583.1 | 0.4% |
Fig. 2(e)
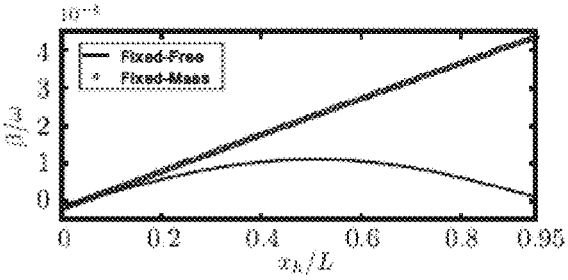
Fig. 3(a)
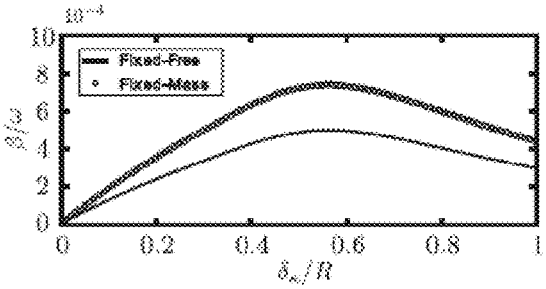
Fig. 3(b)
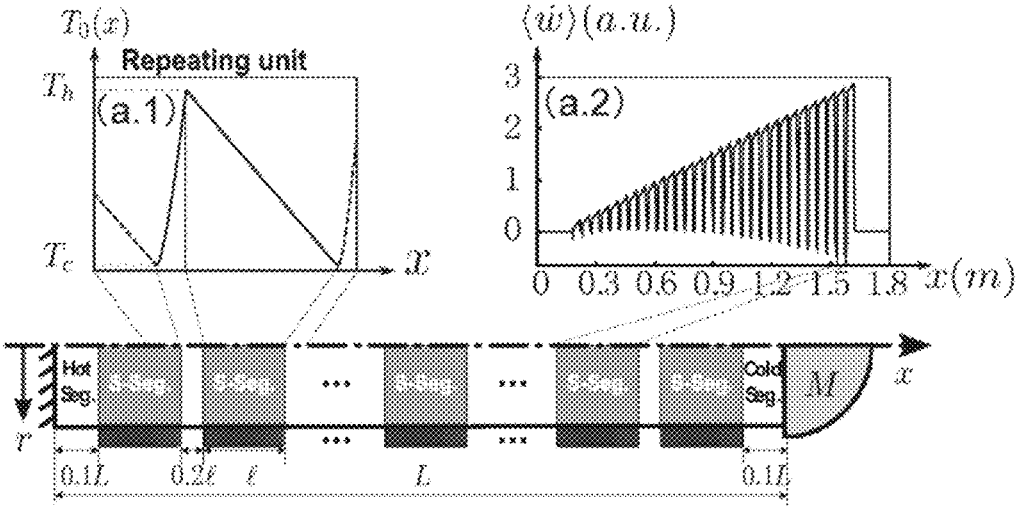
Fig. 4(a)

| | Case A | Case B | Case C |
|---|---|---|---|
| $x_s/L$ | 0.845 | 0.415 | 0.715 |

THERMOACOUSTIC DEVICE AND METHOD OF MAKING THE SAME

CROSS-REFERENCE TO RELATED APPLICATIONS

The present U.S. Patent Application is related to and claims the priority benefit of U.S. Provisional Patent Application Ser. No. 62/725,258, filed Aug. 30, 2018, the contents of which is hereby incorporated by reference in its entirety into this disclosure.

BACKGROUND

This section introduces aspects that may help facilitate a better understanding of the disclosure. Accordingly, these statements are to be read in this light and are not to be understood as admissions about what is or is not prior art.

The existence of thermoacoustic oscillations in thermally-driven fluids and gases has been known for centuries. When a pressure wave travels in a confined gas-filled cavity while being provided heat, the amplitude of the pressure oscillations can grow unbounded. This self-sustaining process builds upon the dynamic instabilities that are intrinsic in the thermoacoustic process.

In 1850, Soundhauss experimentally showed the existence of heat-generated sound during a glassblowing process. Few years later (1859), Rijke discovered another method to convert heat into sound based on a heated wire gauze placed inside a vertically oriented open tube. He observed self-amplifying vibrations that were maximized when the wire gauze was located at one-fourth the length of the tube. Later, Rayleigh presented a theory able to qualitatively explain both Soundhauss and Rijke thermoacoustic oscillations phenomena. In 1949, Kramers was the first to start the formal theoretical study of thermoacoustics by extending Kirchhoff s theory of the decay of sound waves at constant temperature to the case of attenuation in presence of a temperature gradient. Rott et al. made key contributions to the theory of thermoacoustics by developing a fully analytical, quasi-one-dimensional, linear theory that provided excellent predictive capabilities. It was mostly Swift, at the end of the last century, who started a prolific series of studies dedicated to the design of various types of thermoacoustic engines based on Rott's theory. Since the development of the fundamental theory, many studies have explored practical applications of the thermoacoustic phenomenon with particular attention to the design of engines and refrigerators. However, to-date, thermoacoustic instabilities have been theorized and demonstrated only for fluids.

SUMMARY

In this application, we provide theoretical and numerical evidence of the existence of this phenomenon in solid media. We show that a solid metal rod subject to a prescribed temperature gradient on its outer boundary can undergo self-sustained vibrations driven by a thermoacoustic instability phenomenon.

We first introduce the theoretical framework that uncovers the existence and the fundamental mechanism at the basis of the thermoacoustic instability in solids. Then, we provide numerical evidence to show that the instability can be effectively triggered and sustained. We anticipate that, although the fundamental physical mechanism resembles the thermoacoustic of fluids, the different nature of sound and heat propagation in solids produces noticeable differences in the theoretical formulations and in the practical implementations of the phenomenon.

The fundamental system under investigation consists of a slender solid metal rod with circular cross section (FIG. 1). The rod is subject to a temperature (spatial) gradient applied on its outer surface at a prescribed location, while the remaining sections have adiabatic boundary conditions. We investigate the coupled thermoacoustic response that ensues as a result of an externally applied thermal gradient and of an initial mechanical perturbation of the rod.

We anticipate that the fundamental dynamic response of the rod is governed by the laws of thermoelasticity. According to classical thermoelasticity, an elastic wave traveling through a solid medium is accompanied by a thermal wave, and viceversa. The thermal wave follows from the thermoelastic coupling which produces local temperature fluctuations (around an average constant temperature $T_0$) as a result of a propagating stress wave.

When the elastic wave is not actively sustained by an external mechanical source, it attenuates and disappears over a few wavelengths due to the presence of dissipative mechanisms (such as, material damping); in this case the system has a positive decay rate (or, equivalently, a negative growth rate). In the ideal case of an undamped thermoelastic system, the mechanical wave does not attenuate but, nevertheless, it maintains bounded amplitude. In such situation, the total energy of the system is conserved (energy is continuously exchanged between the thermal and mechanical waves) and the stress wave exhibits a zero decay rate (or, equivalently, a zero growth rate).

Contrarily to the classical thermoelastic problem where the medium is at a uniform reference temperature $T_0$ with an adiabatic outer boundary, when the rod is subject to heat transfer through its boundary (i.e. non-adiabatic conditions) the thermoelastic response can become unstable. In particular, when a proper temperature spatial gradient is enforced on the outer boundary of the rod then the initial mechanical perturbation can grow unbounded due to the coupling between the mechanical and the thermal response. This last case is the exact counterpart that leads to thermoacoustic response in fluids, and it is the specific condition analyzed in this study. For the sake of clarity, we will refer to this case, which admits unstable solutions, as the thermoacoustic response of the solid (in order to differentiate it from the classical thermoelastic response).

One aspect of the present application relates to a thermoacoustic device includes a stage coupled to a bar, wherein the stage includes a first heating component on a first terminus of the stage. The stage further includes a first cooling component on a second terminus of the stage. A thermal conductivity of the stage is higher than a thermal conductivity of the bar. A heat capacity of the stage is higher than a heat capacity of the bar.

Another aspect of the present application relates to a thermoacoustic device including a stage coupled to a bar, wherein the stage includes a first heating component on a first terminus of the stage. Additionally, the stage includes a first cooling component on a second terminus of the stage. A thermal conductivity of the stage is higher than a thermal conductivity of the bar. A heat capacity of the stage is higher than a heat capacity of the bar, and the bar forms a closed loop. Moreover, the thermoacoustic device includes a second cooling component on the bar, wherein the second cooling component is configured to cool to a same temperature as the first cooling component.

Still another aspect of the present application relates to a thermoacoustic device including a stage coupled to a bar, wherein the stage includes a first heating component on a first terminus of the stage. Additionally, the stage includes a first cooling component on a second terminus of the stage. A thermal conductivity of the stage is higher than a thermal conductivity of the bar. A heat capacity of the stage is higher than a heat capacity of the bar. Moreover, the bar includes a material wherein the material does not oxidize at temperatures ranging from −100° C. to 2000° C. Further, the material remains a solid at temperatures ranging from −100° C. to 2000° C.

BRIEF DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry, various features may not be drawn to scale and are used for illustration purposes only. In fact, the dimensions of the various features in the drawings may be arbitrarily increased or reduced for clarity of discussion.

FIG. 1(*b*) illustrates idealized reference temperature profile produced along the rod.

FIG. 2(*b*) illustrates time averaged volume change work along the length of the rod showing that the net work is generated in the stage. FIG. 2(*c*) illustrates evolution of an infinitesimal volume element during the different phases of the thermodynamic cycle. FIG. 2(*d*) illustrates time history of the axial displacement fluctuation at the end of the rod for the fixed mass configuration. FIG. 2(*e*) illustrates a table presenting a comparison of the results between the quasi-1D theory and the numerical FE 3D model.

FIG. 3(*a*) illustrates growth ratio versus the location of the stage non-dimensionalized by the length L of the rod. FIG. 3(*b*) illustrates growth ratio versus the penetration thickness non-dimensionalized by the rod radius R.

FIG. 4(*b*) illustrates undamped time response at the moving end of a fixed-mass rod. FIG. 4(*c*) illustrates 1% damped time response at the moving end of a fixed-mass rod.

FIG. 5(*b*) illustrates a resonance rod. FIG. 5(*c*) illustrates temperature profile of the looped rod. FIG. 5(*d*) illustrates temperature profile of the resonance rod.

FIG. 10(*b*) illustrates cycle-averaged mechanical power for the looped rod. FIG. 10(*c*) illustrates cycle-averaged heat flux for the resonance rod. FIG. 10(*d*) illustrates cycle-averaged mechanical power for the resonance rod.

FIG. 12(*b*) illustrates an acoustic energy budget (RHS) for the traveling wave configuration. FIG. 12(*c*) illustrates an acoustic energy budget (LHS) for the standing wave configuration. FIG. 12(*d*) illustrates an acoustic energy budget (RHS) for the standing wave configuration.

DETAILED DESCRIPTION

The following disclosure provides many different embodiments, or examples, for implementing different features of the present application. Specific examples of components and arrangements are described below to simplify the present disclosure. These are examples and are not intended to be limiting. The making and using of illustrative embodiments are discussed in detail below. It should be appreciated, however, that the disclosure provides many applicable concepts that can be embodied in a wide variety of specific contexts. In at least some embodiments, one or more embodiment(s) detailed herein and/or variations thereof are combinable with one or more embodiment(s) herein and/or variations thereof.

In order to show the existence of the thermoacoustic phenomenon in solids, we developed a theoretical three-dimensional model describing the fully-coupled thermoacoustic response. The model builds upon the classical thermoelastic theory developed by Biot further extended in order to account for coupling terms that are key to capture the thermoacoustic instability. Starting from the fundamental conservation principles, the nonlinear thermoacoustic equations for a homogeneous isotropic solid in an Eulerian reference frame are written as:

$$\rho\frac{Dv_i}{Dt} = \sum_{j=1}^{3}\frac{\partial\sigma_{ji}}{\partial x_j} + F_{b,i}, \tag{1}$$

$$\rho c_\epsilon\frac{DT}{Dt} + \frac{\alpha ET}{1-2\nu}\frac{De_v}{Dt} = \sum_{j=1}^{3}\frac{\partial}{\partial x_j}\left(\kappa\frac{\partial T}{\partial x_j}\right) + \dot{q}_g, \tag{2}$$

Eqs. (1) and (2) are the conservation of momentum and energy, respectively. In the above equations ρ is the material density, E is the Young's modulus, ν is the Poisson's ratio, α is the thermoelastic expansion coefficient, $c_\epsilon$ is the specific heat at constant strain, κ is the thermal conductivity of the medium, $v_i$ is the particle velocity in the $x_i$ direction, $\sigma_{ji}$ is the stress tensor with i,j=1, 2, 3, $$D/Dt = \frac{\partial 0}{\partial t} + \sum_{i=1}^{3} v_i \cdot \frac{\partial 0}{\partial x_i}$$

is the material derivative, T is the total temperature, and $e_v$ is the volumetric dilatation which is defined as $e_v=\Sigma_{j=1}^{3}\varepsilon_{jj}$. $F_{b,i}$ and .$q_g$ are the mechanical and thermal source terms, respectively. The stress-strain constitutive relation for a linear isotropic solid, including the Duhamel components of temperature induced strains, is given by:

$$\sigma_{ij}=2\mu\varepsilon_{ij}+[\lambda_L e_v-\alpha(2\mu+3\lambda_L)(T-T_0)]\delta_{ij}, \tag{3}$$

where $\mu$ and $\lambda_L$ are the Lame constants, $\varepsilon_{ij}$ is the strain tensor, $T_0$ is the mean temperature, and $\delta_{ij}$ is the Kronecker delta.

Figure 1A:
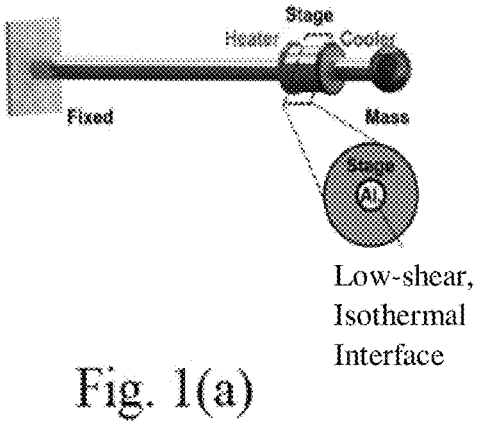
FIG. 1(*a*) illustrates a system exhibiting thermoacoustic response.
Figure 1B:
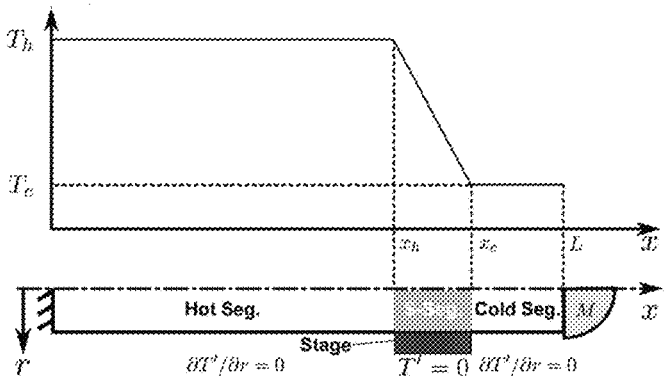

The fundamental element for the onset of the thermoacoustic instability is the application of a thermal gradient. In classical thermoacoustics of fluids, the gradient is applied by using a stack element which enforces a linear temperature gradient over a selected portion of the domain. The remaining sections are kept under adiabatic conditions. In analogy to the traditional thermoacoustic design, we enforced the thermal gradient using a stage element that can be thought as the equivalent of a single-channel stack. Upon application of the stage, the rod could be virtually divided in three segments: the hot segment, the S-segment, and the cold segment (FIG. 1(*b*)). The hot and cold segments were kept under adiabatic boundary conditions. The S-segment was the region underneath the stage, where the spatial temperature gradient was applied and heat exchange could take place. An important consideration must be drawn at this point. For optimal performance, the interface between the stage and the rod should be highly conductive from a thermal standpoint, while providing negligible shear rigidity. This is a challenging condition to satisfy in mechanical systems and highlights a complexity that must be overcome to perform an experimental validation.

Under the conditions described above, the governing equations can be solved in order to show that the dynamic response of the solid accepts thermoacoustically unstable solutions. In the following, we use a two-fold strategy to characterize the response of the system based on the governing equations (Eqns. (1) and (2)). First, we linearize the governing equations and synthesize a quasi-one-dimensional theory in order to carry on a stability analysis. This approach allows us to get deep insight into the material and geometric parameters contributing to the instability. Then, in order to confirm the results from the linear stability analysis and to evaluate the effect of the nonlinear terms, we solve numerically the 3D nonlinear model to evaluate the response in the time domain.

Before concluding this section we should point out a noticeable difference of our model with respect to the classical thermoelastic theory of solids. Due to the existence of a mean temperature gradient $T_0(x)$, the convective component of the temperature material derivative is still present, after linearization, in the energy equation. This term typically cancels out in classical thermoelasticity, given the traditional assumption of a uniform background temperature $T_0$=const., while it is the main driver for thermally-induced oscillations.

In order to perform a stability analysis, we first extract the one-dimensional governing equations from Eqns. (1) and (2) and then proceed to their linearization. The linearization is performed around the mean temperature $T_0(x)$, which is a function of the axial coordinate x. The mean temperature distribution in the hot segment $T_h$ and in the cold segment $T_c$ are assumed constant. Note that even if these temperature profiles were not constant, the effect on the instability would be minor as far as the segments were maintained in adiabatic conditions. The $T_0$ profile on the isothermal section follows from a linear interpolation between $T_h$ and $T_c$ (see FIG. 1).

The following quasi-1D analysis can be seen as an extension to solids of the well-known Rott's stability theory. We use the following assumptions: a) the rod is axisymmetric, b) the temperature fluctuations caused by the radial deformation are negligible, and c) the axial thermal conduction of the rod is also negligible (the implications of this last assumption are further discussed in supplementary material).

According to Rott's theory, we transform Eqns. (1) and (2) to the frequency domain under the ansatz that all fluctuating (primed) variables are harmonic in time. This is equivalent to $(\ )'=(\ )-(\ )_0=(\hat{\ })\,e^{i\Lambda t}$, where $(\hat{\ })$ is regarded as the fluctuating variable in frequency domain. $\Lambda=-i\beta+\omega$, $\omega$ is the angular frequency of the harmonic response, and $\beta$ is the growth rate (or the decay rate, depending on its sign). By substituting Eqn. (3) in Eqn. (1) and neglecting the source terms, the set of linearized quasi-1D equations are:

$$i\Lambda\hat{u}=\hat{v}, \tag{4}$$

$$i\Lambda\hat{v}=\frac{E}{\rho}\left(\frac{d^2\hat{u}}{dx^2}-\alpha\frac{d\hat{T}}{dx}\right), \tag{5}$$

$$i\Lambda\hat{T}=-\frac{dT_0}{dx}\hat{v}-\gamma_G T_0\frac{d\hat{v}}{dx}-\alpha_H\hat{T}, \tag{6}$$

where $$\gamma_G=\frac{\alpha E}{\rho c_\varepsilon(1-2\nu)}$$

is the Grüneisen constant, i is the imaginary unit, $\hat{u}$, $\hat{v}$ and $\hat{T}$ are the fluctuations of the particle displacement, particle velocity, and temperature averaged over the cross section of the rod. For brevity, they will be referred to as fluctuation terms in the following. The intermediate transformation $i\Lambda\hat{u}=\hat{v}$ avoids the use of quadratic terms in $\Lambda$, which ultimately enables the system to be fully linear. The $\alpha_H\hat{T}$ term in Eqn. 6 accounts for the thermal conduction in the radial direction, and it is the term that renders the theory quasi-1D. The function $\alpha_H$ is given by:

$$\alpha_H=\begin{cases}\dfrac{\omega\xi_{top}\dfrac{J_1(\xi_{top})}{J_0(\xi_{top})}}{i\xi_{top}\dfrac{J_1(\xi_{top})}{J_0(\xi_{top})}-\dfrac{R^2}{\delta_k^2}} & x_h<x<x_c\\ 0 & \text{elsewhere,}\end{cases} \tag{7}$$

where $J_n(\bullet)$ are Bessel functions of the first kind, and $\xi$ is a dimensionless complex radial coordinate given by $$\xi=\sqrt{-2i}\,\frac{r}{\delta_k}, \tag{8}$$

and thus, the dimensionless complex radius is $$\xi_{top}=\sqrt{-2i}\,\frac{R}{\delta_k},$$

where R is the radius of the rod. The thermal penetration thickness $\delta_k$ is defined as $$\delta_k = \sqrt{\frac{2\kappa}{\omega\rho c_\epsilon}},$$

and physically represents the depth along the radial direction (measured from the isothermal boundary) that heat diffuses through.

The one-dimensional model was used to perform a stability eigenvalue analysis. The eigenvalue problem is given by $(i\Lambda I-A)y=0$ where I is the identity matrix, A is a matrix of coefficients, 0 is the null vector, and $y=[\hat{u};\ \hat{v};\ \hat{T}]$ is the vector of state variables where $\hat{u}$, $\hat{v}$, and $\hat{T}$ are the particle displacement, particle velocity, and temperature fluctuation eigenfunctions.

The eigenvalue problem was solved numerically for the case of an aluminum rod having a length of L=1.8 m and a radius R=2.38 mm. The following material parameters were used: density $\rho=^{2700}$ kg/m$^3$, Young's modulus E=70 GPa, thermal conductivity $\kappa$=238 W/(mK), specific heat at constant strain $c_\in$=900 J/(kgK), and thermal expansion coefficient $\alpha=23\times10^{-6}$ K$^{-1}$. The strength of the instability in classical thermoacoustics (often quantified in terms of the ratio $\beta/\omega$) depends, among the many parameters, on the location of the thermal gradient. This location is also function of the wavelength of the acoustic mode that triggers the instability, and therefore of the specific (mechanical) boundary conditions. We studied two different cases: 1) fixed-free and 2) fixed-mass. In the fixed-free boundary condition case, the optimal location of the stage was approximately around ½ of the total length of the rod, which is consistent with the design guidelines from classical thermoacoustics. Considerations on the optimal design and location of the stage/stack will be addressed in subsequent paragraphs; at this point we assumed a stage located at x=0.5 L with a total length of 0.05 L.

Assuming a mean temperature profile equal to $\$T_h$=493.15K in the hot part and to $\$T_c$=293.15K in the cold part, the 1D theory returned the fundamental eigenvalue to be $i\Lambda$=0.404+i4478(rad/s). The existence of a positive real component of the eigenvalue revealed that the system was unstable and self-amplifying, that is it could undergo growing oscillations as a result of the positive growth rate $\beta$. The growth ratio was found to be $\beta/\omega=9.0\times10^{-5}$.

Equivalently, we analyzed the second case with fixed-mass boundary conditions. In this case, a 2 kg tip mass was attached to the free end with the intent of tuning the resonance frequency of the rod and increasing the growth ratio $\beta/\omega$ which controls the rate of amplification of the system oscillations. An additional advantage of this configuration is that the operating wavelength increases. To analyze this specific boundary condition configuration, we chose $\$x_h$=0.9 L and $\$x_c-x_h$=0.05 L. The stability analysis returned the first eigenvalue as $i\Lambda$=0.210+i585.5(rad/s)i resulting in a growth ratio $\beta/\omega=3.6\times10\hat{}^{-4}$, larger than the fixed-free case.

The above results from the quasi-1D thermoacoustic theory provided a first important conclusion of this study, that is confirming the existence of thermoacoustic instabilities in solids as well as their conceptual affinity with the analogous phenomenon in fluids.

Figure 2A:
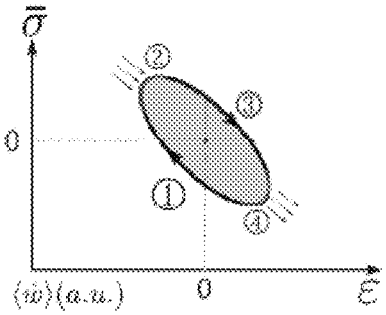
FIG. 2(*a*) illustrates thermodynamic cycle of a Lagrangian particle in the S-segment during an acoustic/elastic cycle.
Figure 2B:
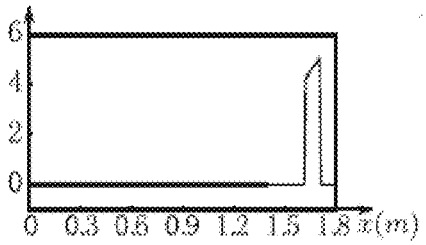
Figure 2C:
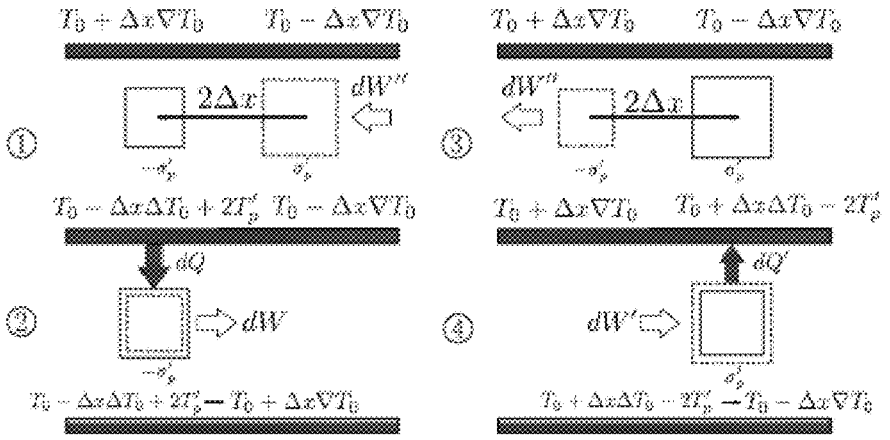

To get a deeper physical insight into this phenomenon, we studied the themodynamic cycle of a particle located in the S-region. The mechanical work transfer rate or, equivalently, the volume-change work per unit volume may be defined as $$\dot{w} = -\sigma\frac{\partial\varepsilon}{\partial t},$$

where $\sigma$ and $\varepsilon$ are the total axial stress (i.e. including both mechanical and thermal components) and strain, respectively. During one acoustic/elastic cycle, the time averaged work transfer rate per unit volume is $$\langle\dot{w}\rangle = \frac{1}{\tau}\int_0^\tau(-\sigma)\frac{\partial\varepsilon}{\partial t}dt = \frac{1}{\tau}\int_0^\tau(-\sigma)d\varepsilon = \frac{1}{\tau}\int_0^\tau\bar{\sigma}d\varepsilon,$$

where $\tau$ is the period of a cycle, and $\bar{\sigma}=(-\sigma)$. FIG. 2(*a*) shows the $\bar{\sigma}-\varepsilon$ diagram where the area enclosed in the curve represents the work per unit volume done by the infinitesimal volume element in one cycle. All the particles located in the regions outside the S-segment do not do net work because the temperature fluctuation T' is in phase with the strain $\varepsilon$, which ultimately keeps the stress and strain in phase (thus, the area enclosed is zero). FIG. 2(*b*) shows the time-averaged work $\langle\dot{w}\rangle=\frac{1}{2}\,\mathrm{Re}\,[\hat{\bar{\sigma}}(i\omega\hat{\varepsilon})^*]$ along the rod, where $(\ )^*$ denotes the complex conjugate. Note that the rate of work $\langle\dot{w}\rangle$ was evaluated based on modal stresses and strains, therefore its value must be interpreted on an arbitrary scale. The large increase of $\langle\dot{w}\rangle$ at the stage location indicates that a non-zero net work is only done in the section where the temperature gradient is applied (and therefore where heat transfer through the boundary takes place).

FIG. 2(*c*) shows a schematic representation of the thermomechanical process taking place over an entire vibration cycle. When the infinitesimal volume element is compressed, it is displaced along the x direction while its temperature increases (step 1). As the element reaches a new location, heat transfer takes place between the element and its environment. Assuming that in this new position the element temperature is lower than the surrounding temperature, then the environment provides heat to the element causing its expansion. In this case, the element does net work dW (step 2) due to volume change. Similarly, when the element expands (step 3), the process repeats analogously with the element moving backwards towards the opposite extreme where it encounters surrounding areas at lower temperature so that heat is now extracted from the particle (and provided to the stage). In this case, work dW' is done on the element due to its contraction (step 4). The net work generated during one cycle is dW-dW'.

In order to validate the quasi-1D theory and to estimate the possible impact of three-dimensional and nonlinear effects, we solved the full set of Eqns. (1) and (2) in the time domain.

The equations were solved by finite element method on a three-dimensional geometry using the commercial software Comsol Multiphysics. We highlight that with respect to Eqns. (1) we drop the nonlinear convective derivative $$v_i\frac{\partial v_i}{\partial x_i}$$

which effectively results in the linearization of the momentum equation. Full nonlinear terms are instead retained in the energy equation.

FIG. 2(*d*) shows the time history of the axial displacement fluctuation u' at the free end of the rod. The dominant frequency of the oscillation is found, by Fourier transform, to be equal to $\omega$=583.1(rad/s), which is within 0.4% from the prediction of the 1D theory. The time response is evidently growing in time therefore showing clear signs of instability. The growth rate was estimated by either a logarithmic increment approach or an exponential fit on the envelope of the response. The logarithmic increment approach returns $\beta$ as:

$$\beta = \frac{1}{N-1}\sum_{i=2}^{N} \ln\frac{A_i}{A_1} \Big/ (t_i - t_1), \tag{9}$$

where $A_1$ and $A_i$ are the amplitudes of the response at the time instant $t_1$ and $t_i$, and where $t_1$ and $t_i$ are the start time and the time after (i−1) periods. Both approaches return $\beta$=0.212 (rad/s). This value is found to be within 1% accuracy from the value obtained via the quasi-1D stability analysis, therefore confirming the validity of the 1D theory and of the corresponding simplifying assumptions.

In reviewing the thermoacoustic phenomenon in both solids and fluids we note similarities as well as important differences between the underlying mechanisms. These differences are mostly rooted in the form of the constitutive relations of the two media.

Both the longitudinal mode and the transverse heat transfer are pivotal quantities in thermal-induced oscillations of either fluids or solids. The longitudinal mode sustains the stable vibration and provides the necessary energy flow, while the transverse heat transfer controls the heat and momentum exchange between the medium and the stage/stack.

The growth rate of the mechanical oscillations is affected by several parameters including the amplitude of the temperature gradient, the location of the stage, the thermal penetration thickness, and the energy dissipation in the system. Here below, we investigate these elements individually. The effect of the temperature gradient is straightforward because higher gradients result in higher growth rate.

The location of the stage relates to the phase lag between the particle velocity and the temperature fluctuations, which is one of the main driver to achieve the instability. In fluids, the optimal location of the stack in a tube with closed ends is about one-forth the tube length, measured from the hot end. In a solid, we show that the optimal location of the stage is at the midspan for the fixed-free boundary condition, and at the mass end for the fixed-mass boundary condition (FIG. 3*a*). This conclusion is consistent with similar observations drawn in thermoacoustics of fluids where a closed tube (equivalent to a fixed-fixed boundary condition in solids) gives a half-wavelength tube ($L_{0.5}$=½$\lambda$, where $\lambda$ indicates wavelength, $L_{0.5}$ and $L_{0.25}$ length of a half- and quarter-wavelength rod/tube respectively). The optimal location, ¼ tube length, is equivalent to ⅛ wavelength ($x_{opt}$=¼$L_{0.5}$=⅛$\lambda$). While in solids, if a fixed-free boundary condition is applied, ⅛ wavelength corresponds exactly to the midpoint of a quarter-wavelength rod ($x_{opt}$=⅛$\lambda$=½(¼$\lambda$)=½$L_{0.25}$). For a rod of 1.8 m in length and 2.38 mm in radius with a 2 kg tip mass mounted at the end, the wavelength is approximately $$\lambda = \frac{c}{f} \approx \frac{\sqrt{E/\rho}}{f} = \frac{5091}{92.8} \approx 55m,$$

while $\lambda$/8=6.86 m is beyond the total length of the rod L=1.8 m. Hence, in this case the optimal location of the stage approaches the end mass.

The thermal penetration thickness $$\delta_k = \sqrt{\frac{2\kappa}{\omega\rho c_\epsilon}}$$

indicates the distance, measured from the isothermal boundary, that heat can diffuse through. Solid particles that are outside this thermal layer do not experience radial temperature fluctuations and therefore do not contribute to building the instability. The value of the thermal penetration thickness $\delta_k$, or more specifically, the ratio of $\delta_k$/R is a key parameter for the design of the system. Theoretically, the optimal value of this parameter is attained when the rod radius is equal to $\delta_k$. In fluids, good performance can be obtained for values of $2\delta_k$ to $3\delta_k$. Here below, we study the optimal value of this parameter for the two configurations above.

In the quasi-1D case, once the material, the length of the rod, and the boundary conditions are selected, the frequencies of vibration of the rod (we are only interested in the frequency $\omega$ that corresponds to the mode selected to drive the thermoacoustic growth) is fixed. This statement is valid considering that the small frequency perturbation associated to the thermal oscillations is negligible. Under the above assumptions, also $\delta_k$ is fixed; therefore, the ratio R/$\delta_k$ can be effectively optimized by tuning R. FIG. 3(*b*) shows that a rod having $$R = \frac{\delta_k}{0.56} \approx 2\delta_k$$

yields the highest growth ratio $\beta/\omega$ for both boundary conditions. The above analysis shows that the optimal values of $x_k$/L and $\delta_k$/R are quantitatively equivalent to their counterparts in fluids.

Another important factor is the energy dissipation of the system. This is probably the element that differentiates more clearly the thermoacoustic process in the two media. The mechanism of energy dissipation in solids, typically referred to as damping, is quite different from that occurring in fluids. Although in both media damping is a macroscopic manifestation of non-conservative particle interactions, in solids their effect can dominate the dynamic response. Considering that the thermoacoustic instability is driven by the first axial mode of vibration, some insight in the effect of damping in solids can be obtained by mapping the response of the rod to a classical viscously damped oscillator. The harmonic response of an underdamped oscillator is of the general form $x(t)=Ae^{i\Lambda_D t}$, where $i\Lambda_D$ is the system eigenvalue given by $i\Lambda_D-\zeta\Omega_0+i\sqrt{1-\zeta^2}\omega_0$, where $\omega_0$ is the undamped angular frequency, and $\zeta$ is the damping ratio. The damping contributes to the negative real part of the system eigenvalue, therefore effectively counteracting the thermoacoustic growth rate (which, as shown above, requires a positive real part). In order to obtain a net growth rate, the thermally induced growth (i.e. the thermoacoustic effect) must always exceed the decay produced by the material damping. Mathematically, this condition translates into the ratio $$\frac{\beta}{\omega} > \zeta.$$

For metals, the damping ratio $\zeta$ is generally very small (on the order of 1% for aluminum). By accounting for the damping term in the above simulations, we observe that the undamped growth ratio $$\frac{\beta}{\omega}$$

becomes one or two orders of magnitude lower than the damping ratio $\zeta$. Therefore, despite the relatively low intrinsic damping of the material the growth is effectively impeded.

We notes that in fluids, the dissipation is dominated by viscous losses localized near the boundaries. This means that while particles located close to the boundaries experience energy dissipation, those in the bulk can be practically considered loss-free. Under these conditions, even weak pressure oscillations in the bulk can be sustained and amplified. In solids, structural damping is independent of the spatial location of the particles (in fact it depends on the local strain). Therefore, the bulk can still experience large dissipation. In other terms, even considering an equivalent dissipation coefficient between the two media, the solid would always produce a higher energy dissipation per unit volume.

Additionally, the net work during a thermodynamic cycle in fluids is done by thermal expansion at high pressure (or stress, in the case of solids) and compression at low pressure. Thermal deformation in fluids and solids can occur on largely disparate spatial scales. This behavior mostly reflects the difference in the material parameters involved in the constitutive laws with particular regard to the Young's modulus and the thermal expansion coefficient. In general terms, a solid exhibits a lower sensitivity to thermal-induced deformations which ultimately limits the net work produced during each cycle, therefore directly affecting the growth rate of the system.

In principle, we could act on both the above mentioned factors in order to get a strong thermoacoustic instability in solids. Nevertheless, damping is an inherent attribute of materials and it is more difficult to control. Therefore, unless we considered engineered materials able to offer highly controllable material properties, pursuing approaches targeted to reducing damping appears less promising. On the other hand, we choose to explore an approach that targets directly the net work produced during the cycle.

In the previous paragraphs, we indicated that thermoacoustics in solids is more sensitive to dissipative mechanisms because of the lower net work produced in one cycle. In order to address directly this aspect, we conceived a multiple stage (here below referred to as multi-stage) configuration targeted to increase the total work per cycle. As the name itself suggests, this approach simply uses a series of stages uniformly distributed along the rod. The separation distance between two consecutive stages must be small enough, compared to the fundamental wavelength of the standing mode, in order to not alter the phase lag between the temperature and velocity fields.

We tested this design by numerical simulations using thirty stage elements located on the rod section [0.1-0.9] L, with $T_h$=543.15K and $T_c$=293.15K (FIG. 4*a*). The resulting mean temperature distribution $T_0(x) was a periodic saw-tooth-like profile with a total temperature difference per stage $\Delta T$=250K. Note that, in the quasi-1D theory, in order to account for the finite length of each stage and for the corresponding axial heat transfer between the stage and the rod we tailored the gradient according to an exponential decay. In the full 3D numerical model, the exact heat transfer problem is taken into account with no assumptions on the form of the gradient. We anticipate that this gradient has no practical effect on the instability, therefore the assumption made in the quasi-1D theory has a minor relevance. A tip mass M=0.353 kg was used to reduce the resonance frequency and increase the wavelength so to minimize the effect of the discontinuities between the stages.

The stability analysis performed according to the quasi-1D theory returned the fundamental eigenvalue as $i\Lambda_u$=8.15+i598.6(rad/s) without considering damping, and $i\Lambda_u$=2.27+i598.7(rad/s)$ with 1% damping. FIG. 4 shows the time averaged mechanical work $\langle \dot{w} \rangle$ along the rod. The elements in each stage do net work in each cycle. Although the segments between stages are reactive (because the non-uniform $T_0$ still perturbs the phase), their small size does not alter the overall trend. The positive growth rate obtained on the damped system shows that thermoacoustic oscillations can be successfully obtained in a damped solid if a multi-stage configuration is used.

Figure 4B:
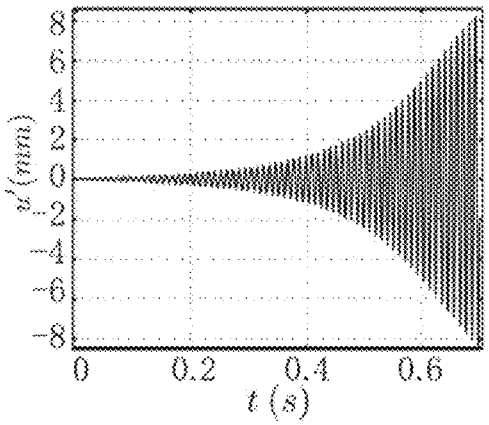
FIG. 4(*a*) illustrates a multi-stage configuration.
Figure 4C:
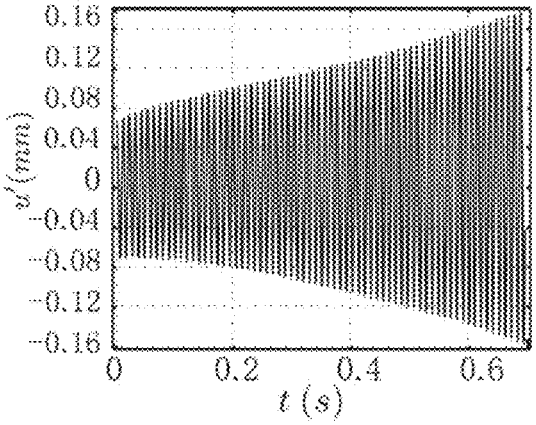
Figure 5A:
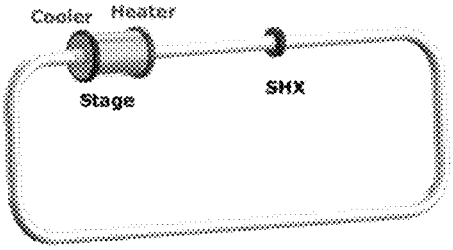
FIG. 5(*a*) illustrates a looped rod.
Figure 5B:
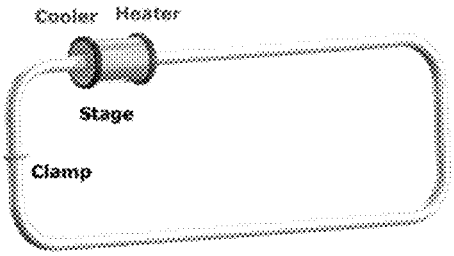
Figure 5C:
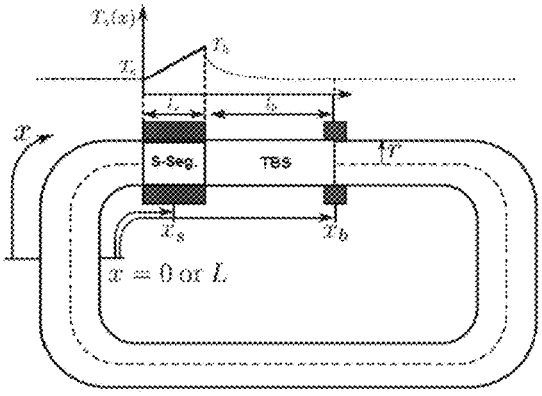
Figure 5D:
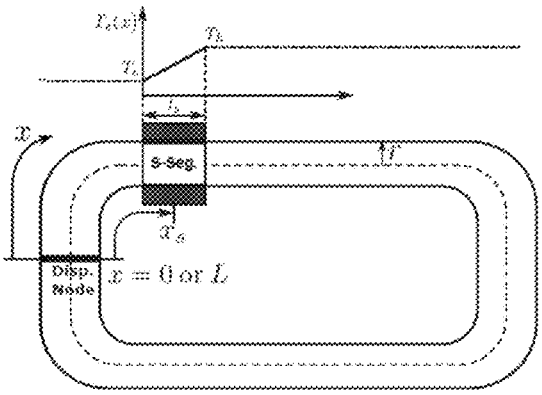

Full 3D simulations were also performed to validate the multi-stage response. FIGS. 4*b* and 4*c* show the time response of the axial displacement fluctuation at the mass-end for both the undamped and the damped rods. The growth rates for the two cases are $\beta_u$=6.87(rad/s) (undamped) and $\beta_d$=1.28(rad/s) (damped). Contrarily to the single stage case, these results are in larger error with respect to those provided by the 1D solver. In the multi-stage configuration, the quasi-1D theory is still predictive but not as accurate. The reason for this discrepancy can be attributed to the effect of axial heat conduction. For the single stage configuration, the net axial heat flux $$\kappa \frac{\partial^2 \hat{T}}{\partial x^2}$$

is mostly negligible other than at the edges of the stage (see FIG. 4). Neglecting this term in the 1D model does not result in an appreciable error. On the contrary, in a multi-stage configuration the existence of repeated interfaces where this term is non-negligible adds up to an appreciable effect (see FIG. 4). This consideration can be further substantiated by comparing the numerical results for an undamped multi-stage rod produced by the 1D model and by the 3D model in which axial conductivity is artificially impeded. These two models return a growth ratio equal to $\beta_{1D}$=6.38(rad/s) and $\beta_{3D}^{\kappa_x=0}$=6.60(rad/s).

The present study confirmed from a theoretical and numerical standpoint the possibility of inducing thermoacoustic response in solids. The next logical step in the development of this new branch of thermoacoustics consists in the design of an experiment capable of validating the SS-TA effect and of quantifying the performance. The most significant challenge that the authors envision consists in the ability to fabricate an efficient interface (stage-medium) capable of high thermal conductivity and negligible shear force. In conventional thermoacoustic systems, it is relatively simple to create a fluid/solid interface with high heat capacity ratio which is a condition conducive to a strong TA response. In solids, the absolute difference between the heat capacities of the constitutive elements (i.e. the stage and the operating medium) is lower but still sufficient to support the TA response. To this regard, we highlight two important factors in the design of an SS-TA device. First, the selection of constitutive materials having large heat capacity ratio is an important design criterion to facilitate the TA response. Second, the stage should have a sufficiently large volume compared to the SS-TA operating medium (in the present case the aluminum rod) in order to behave as an efficient thermal reservoir.

High thermal conductivity at the interface is also needed to approximate an effective isothermal boundary condition while a zero-shear-force contact would be necessary to allow the free vibration of the solid medium with respect to the stage. Such an interface could be approximated by fabricating the stage out of a highly conductive medium (e.g. copper) and using a thermally conductive silver paste as coupler between the stage and the solid rod. Unfortunately, this design tends to reduce the thermal transfer at the interface (compared to the conductivity of copper) and therefore it would either reduce the efficiency or require larger temperature gradients to drive the TA engine. Nonetheless, we believe that optimal interface conditions could be achieved by engineering the material properties of the solid so to obtain tailored thermo-mechanical characteristics.

Concerning the methodologies for energy extraction, the solid state design is particularly well suited for piezoelectric energy conversion. Either ceramics or flexible piezoelectric elements can be easily bonded on the solid element in order to perform energy extraction and conversion. Compared to fluid-based TA systems, the SS-TA presents an important advantage. In SS-TA the acoustic energy is already generated in the form of elastic energy within the solid medium and it can be converted directly via the piezoelectric effect. On the contrary, fluid-based systems require an additional intermediate conversion from acoustic to mechanical energy that further limits the efficiency. It is also worth noting that, with the advent of additive manufacturing, the SS-TA can enable an alternative energy extraction approach if the host medium could be built by combining both active and passive materials fully integrated in a single medium.

The authors expect SS-TA to provide a viable technology for the design, as an example, of engines and refrigerators for space applications (satellites, probes, orbiting stations, etc.), energy extraction or cooling systems driven by hydrogeological sources, and autonomous TA machines (e.g. the ARMY fridge). Although this is a similar range of application compared to fluid-based systems, it is envisioned that solid state thermoacoustics would provide superior robustness and reliability while enabling ultra-compact devices. In fact, solid materials will not be subject to mass or thermal losses that are instead important sources of failure in classical thermoacoustic systems. In addition, the solid medium allows a largely increased design space where structural and material properties can be engineered for optimal performance and reduced dimensions.

We have theoretically and numerically shown the existence of thermoacoustic oscillations in solids. We presented a fully coupled, nonlinear, three-dimensional theory able to capture the occurrence of the instability and to provide deep insight into the underlying physical mechanism. The theory served as a starting point to develop a quasi-1D linearized model to perform stability analysis and characterize the effect of different design parameters, as well as a nonlinear 3D model. The occurrence of the thermoacoustic phenomenon was illustrated for a sample system consisting in a metal rod. Both models were used to simulate the response of the system and to quantify the instability. A multi-stage configuration was proposed in order to overcome the effect of structural damping, which is one of the main differences with respect to the thermoacoustics of fluids.

This study laid the theoretical foundation of thermoacoustics of solids and provided key insights into the underlying mechanisms leading to self-sustained oscillations in thermally-driven solid systems. It is envisioned that the physical phenomenon explored in this study could serve as the fundamental principle to develop a new generation of solid state thermoacoustic engines and refrigerators.

Example 1

In this example, we consider two configurations (FIG. 5) in which a ring-shaped slender metal rod with circular cross section is under investigation. Specifically, they are called the looped rod (FIGS. 5(*a*) and 5(*c*)) and the resonance rod (FIGS. 1(*b*) and 1(*d*)). The rod experiences an externally imposed axial thermal gradient applied via isothermal conditions on its outer surface at a certain location, while the remaining exposed surfaces are adiabatic. The difference between the two configurations lies in the imposition of a displacement/velocity node (FIG. 1(*d*)), which is used in the resonance rod to suppress the traveling wave mode. Practically, the displacement node could be realized by constraining the rod with a clamp at a proper location (FIG. 1(*b*)). The coupled thermoacoustic response induced by the external thermal gradient and the initial mechanical excitation is investigated.

The initial mechanical excitation could grow with time as a result of the coupling between the mechanical and thermal response provided a sufficient temperature gradient is imposed on the outer boundary of a solid rod at a proper location. This phenomenon is identified as the thermoacoustic response of solids.

By analogy with fluid-based traveling wave thermoacoustic engines, a stage element is used to impose a thermal gradient on the surface of the looped rod (FIG. 5(*a*)). The specific location of the stage element in this case is irrelevant due to the periodicity of the system. The segment surrounded by the stage is named S-segment, which experiences a spatial temperature gradient (from $T_c$ to $T_h$) due to the externally enforced temperature distribution. The interface between the stage and the S-segment is ideally assumed to have a high thermal conductivity, which assures the isothermal boundary conditions along with a zero shear stiffness. One can anticipate the compromise between these two seemingly contradictory conditions in an experimental validation. The stage is considered as a thermal reservoir so that the temperature fluctuation on the surface of S-segment is assumed to be zero (isothermal). A Thermal Buffer Segment (TBS) next to the thermal gradient provides a thermal buffer between $T_h$ and room temperature $T_c$. The temperature drop in the TBS is caused by the secondary cold heat exchanger (SHX, FIG. 5(*a*)) located at $x_b$. A linear temperature profile in the TBS from $T_h$ to $T_c$ is adopted to account for the natural axial thermal conduction along the looped rod.

To show the superiority of traveling wave thermoacoustics, a fair comparison was conducted with a resonance rod. The resonance rod, as FIG. 5(*d*) shows, was constructed by enforcing a displacement/velocity node at an arbitrary position labeled x=0. This node is equivalent to a fixed and adiabatic boundary condition. If only plane wave propagation is considered, this resonance rod has no difference with a straight rod with both ends clamped. The TBS is not necessary in the resonance rod since the temperature can be discontinuous at the displacement node. To make a comparison, we calculated the growth ratio of a standing wave mode in the resonance rod with the same wavelength ($\lambda$=L) and frequency (approx. 2830 Hz) as the traveling wave mode in the looped rod without the displacement node. We highlight the essential difference of the mode numbering in FIG. 6 and propose a naming convention for the modes for brevity. The modes in comparison in this example are Loop-I and Res-II (the shaded blocks).

We solved the eigenvalue problem numerically for both cases of a L=1.8 m long aluminum rod, being the looped or the resonance rod, under a $200$K temperature difference ($T_h$=493.15K and $T_c$=293.15K) with a 0.05 L long stage to investigate the thermoacoustic response of the system. The material properties of aluminum are chosen as: Young's modulus E=70 GPa, density p=2700$ kg/m$^3$, thermal expansion coefficient $\alpha=23\times10^{\hat{}-6}K^{-1}$, thermal conductivity $\kappa$=238$ W/(mK) and specific heat at constant strain $c_{\in}$=900$ J/(kgK).

Figure 6:
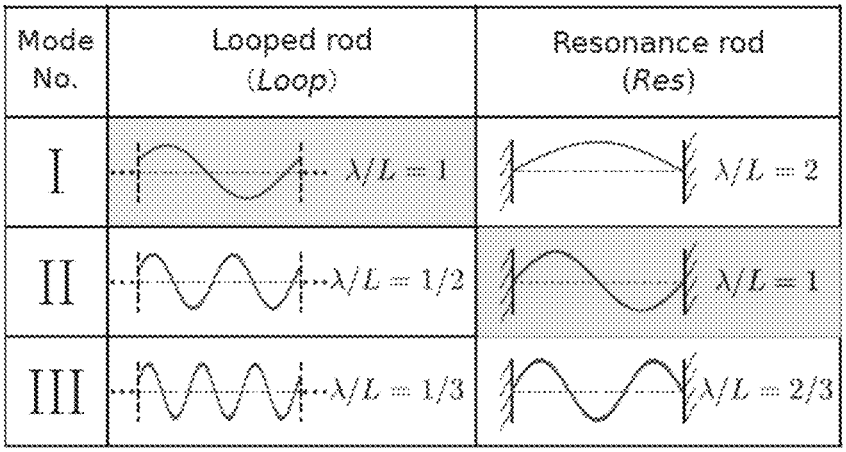
FIG. 6 illustrates mode shapes of the looped and the resonance rod and the naming convention for modes.

The first traveling wave mode in the looped rod, with a full wavelength ($\lambda$=L) is considered, and will be referred to as Loop-I, following the naming convention of modes shown in FIG. 6. The dimensionless growth ratio $\beta/\omega$ is used as a metric of the SSTA engine's ability to convert heat into mechanical energy; such normalization accounts for the fact that thermoacoustic engines operating at high frequencies naturally exhibit high growth rates and vice versa. Besides, in solids the inherent structural damping is commonly expressed as a fraction of the frequency of the oscillations, i.e. the damping ratio; the latter is widely used to quantify the frequency-dependent loss/dissipative effect in solids. The optimal growth ratio was found by gradually varying the radius R of the looped rod. We used the dimensionless radius $R/\delta_k$ to represent the effect of geometry, where $\delta_k$ was assumed to be constant at the operating frequency $$f = \frac{c}{\lambda} \approx \frac{\sqrt{E/\rho}}{L} = 2830 \text{ Hz}.$$

Figure 7:
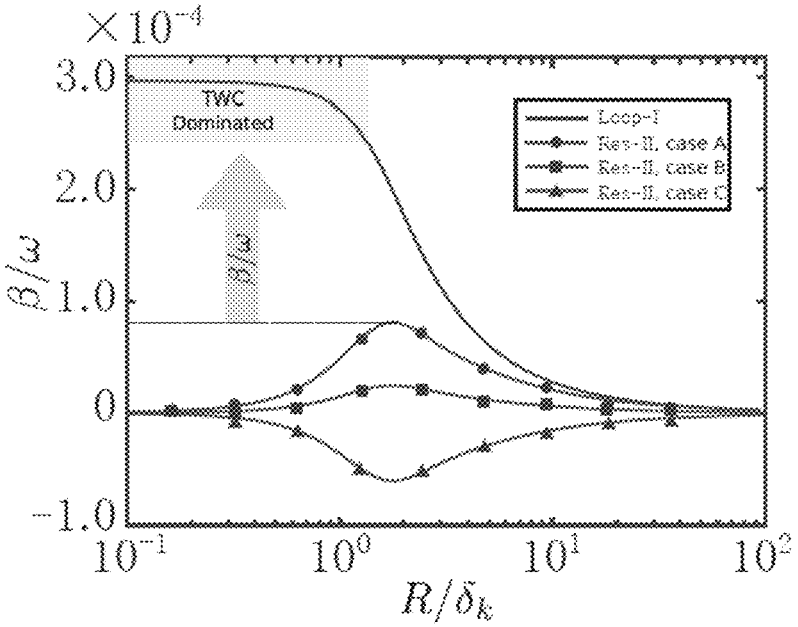
FIG. 7 illustrates a semilog plot of the growth ratio versus the nondimensional radius for the Loop-1 mode in the looped rod and the Res-II mode in the resonance rod.

The $Loop-I curve in FIG. 7 shows the growth ratio $\beta/\omega$ vs. the dimensionless radius $R/\delta_k$ of a full-wavelength traveling wave mode.

The frequency variation with radius is neglected. Positive growth ratios are obtained in the absence of losses, and the losses in solids are mainly induced by intrinsic structural damping. The positive growth ratio suggests that the undamped system is capable of sustaining and amplifying the propagation of a traveling wave. On the other hand, for the resonance rod configuration, only standing-wave thermoacoustic waves can exist since the traveling wave mode is suppressed by the displacement node. In this case, the second mode (also ($\lambda$=L)) is considered, and denoted as Res-II (FIG. 6). The presence of a displacement node also decreases the rod's degree of symmetry. Thus, the stage location, while being irrelevant in the looped rod configuration, crucially affects the growth ratio in the standing wave resonance rod.

Figure 8:
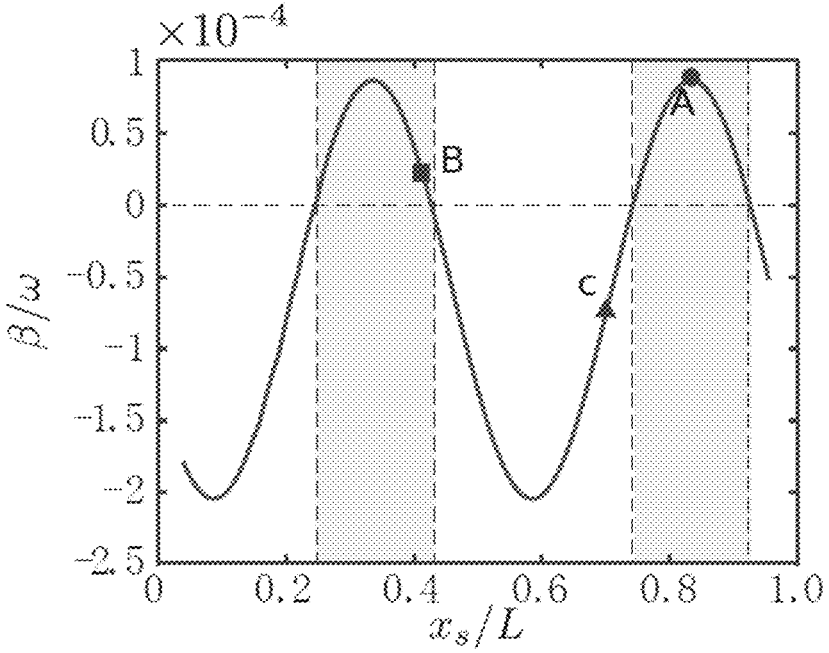
FIG. 8 illustrates plot of the growth ratio versus the normalized stage location for the resonance rod Res-II.

An improper placement of the stage on a resonance rod can lead to a negative growth rate, physically attenuating the oscillations. As FIG. 8 shows, only a proper location falling into the shaded region leads to a positive growth ratio. Other than the stage location, the radius of the rod is also another important factor, which can affect the growth ratio for the resonance rod configuration. In FIG. 7, we show the $\beta/\omega$ vs. $R/\delta_k$ relations of a resonance rod for different stage locations as well. The maximum thermoacoustic response is obtained for a stage location $x_s$=0.845 L (Res-II, case A).

FIG. 7 shows that as $R>>\delta_k$, all the curves, whether the looped or the resonance rod, reach zero due to the weakened thermal contact between the solid medium and the stage. However, as $R/\delta_k$ reaches zero (shaded grey region), the stage is very strongly thermally coupled with the elastic wave. As a result, the traveling wave mode dominates. The stability curves also tell that the traveling wave engine has about 4 times higher growth ratio in the limit $R/\delta_k\rightarrow0$, compared to the standing wave resonance rod (Res-II, case A) in which maximal growth ratio is obtained (at $R/\delta_k\approx2$). The noteworthy improvement on growth ratio is essential to the design of more robust solid state thermoacoustics devices.

Hereafter, the modes or results from Loop-I and Res-II will be taken for values of R of 0.1 mm and 0.184 mm, i.e. $R/\delta_k$ of 1.0 and 1.8 respectively.

Figure 9:
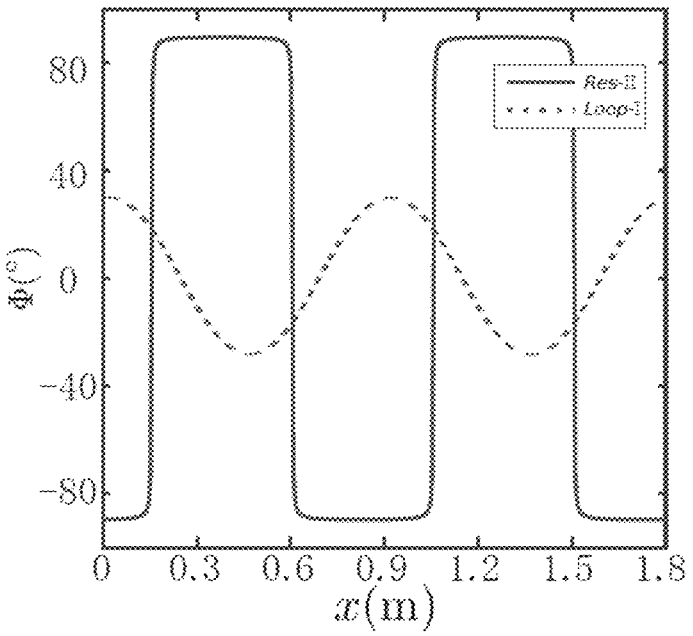
FIG. 9 illustrates plot of phase difference between engative stress and particle velocity for a resonance rod 'Res-II' versus a looped rod 'Loop-1'.
Figure 10A:
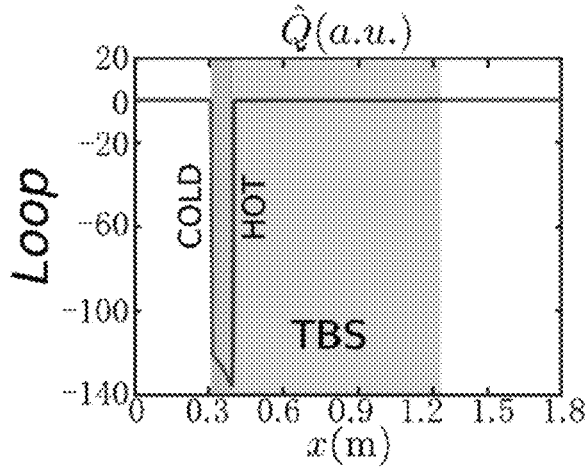
FIG. 10(*a*) illustrates cycle-averaged heat flux for the looped rod.
Figure 10B:
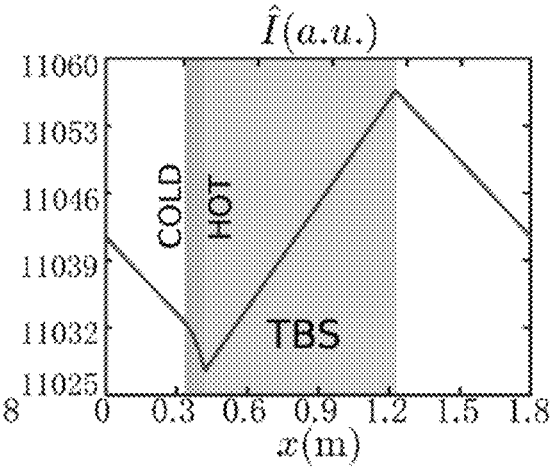
Figure 10C:
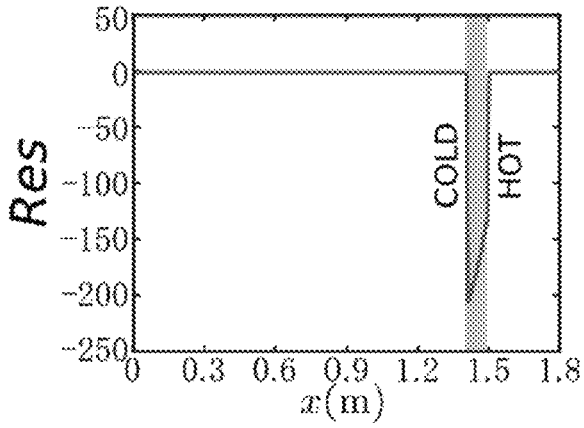
Figure 10D:
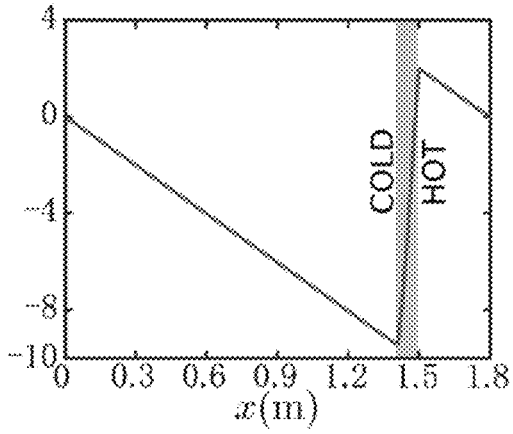

In classical thermoacoustics, the phase delay between pressure and crossectional averaged velocity is an essential controlling parameter of thermoacoustic energy conversion. In analogy with thermoacoustics in fluids, we use the phase difference $\Phi$ between negative stress $\bar{\sigma}=-\sigma=|\hat{\bar{\sigma}}|\mathrm{Re}[e^{i(\omega t+\phi_{\bar{\sigma}})}]$ and particle velocity $v=|\hat{v}|\mathrm{Re}[e^{i(\omega t+\phi_v)}]$, where $\phi_{\bar{\sigma}}$ and $\phi_v$ denote the phases of $\bar{\sigma}$ and v respectively, $\Phi=\phi_v-\phi_{\bar{\sigma}}$. Note that a negative stress in solids indicates compression which is equivalent to a positive pressure in fluids. The standing wave component (SWC) and traveling wave component (TWC) of velocity are quantified as $v_S=|\hat{v}|\mathrm{Re}[e^{i(\omega t+\phi_{\bar{\sigma}}+\pi/2)}]\sin\Phi$ and $v_T=|\hat{v}|\mathrm{Re}[e^{i(\omega t+\phi_{\bar{\sigma}})}]\cos\Phi$, which are 90° out-of-phase and in-phase with $\bar{\sigma}$, respectively. In a resonance rod, TWC is not existent. However, the non-zero growth rate $\beta$ will cause a small phase shift, which makes the phase difference $\Phi$ close to but not exactly 90°. The blue solid line in FIG. 9 shows the phase difference of a R=0.184 mm resonance rod (Res-II). In the case of a thick looped rod ($R>>\delta_k$) with a poor degree of thermal contact, the mode shape is much similar to that of a resonance rod because SWC is still dominant and the phase difference is close to 90°. The displacement nodes may exist intrinsically in the system without clamped points. However, when the looped rod is sufficiently thin ($R\sim\delta_k$) the traveling wave component plays a dominant role. Thus, the phase delay decreases to 30° at most. The dashed line in FIG. 9 shows the phase difference of a R=0.1 mm looped rod (Loop-II). The time history of the displacement along the looped rod shows that, as $R\leq\delta_k$ (small phase difference), the wave mode is dominated by TWC.

We now explore the energy conversion process in the resonance and the looped rods. The resonance rod, 'Res', has a length of 1.8 m, radius of R=0.184 mm and the stage location $x_s$=0.805 L. The looped rod, 'Loop', has the same total length, but the radius R=0.1 mm is selected to allow the TWC to dominate. The location of the stage in looped rods does not influence the thermoacoustic response, thus only for illustrative purposes, it is located at $x_s$=0.205 L so that the TBS does not cross the point where periodicity is applied.

First, we adopt heuristic definitions of heat flux and mechanical power (work flux), analogous to the well-defined heat flux and acoustic power in fluids. The energy budgets are then rigorously derived, naturally yielding the consistent expressions of the second order energy norm, work flux, energy redistribution term, and the thermoacoustic production and dissipation. The efficiency, the ratio of the net gain (which eventually converts into energy growth) to the total heat absorbed by the medium, is defined based on the acoustic energy budgets and it is found that the first mode of the traveling wave engine ('Loop-I') is more efficient than the second standing wave mode ('Res-II').

A cycle-averaged heat flux in the axial direction is generated in the S-segment due to its heat exchange with the stage. Neglecting the axial thermal conductivity, the transport of entropy fluctuations due to the fluctuating velocity $v_1$ (subscript 1 for a first order fluctuating term in time) is the only way heat can be transported along the axial direction, and it is expressed in the time domain as $$\dot{q}_2 = T_0\rho_0(s_1\dot{v}_1)\left[\frac{W}{m^2}\right], \tag{1}$$

The subscript 2 in the heat flux per unit area $\dot{q}_2$ denotes a second order quantity. Entropy fluctuations in solids are related to temperature and strain rate fluctuations via the following relation from thermoelasticity theory $$s_1 = \frac{c_\epsilon}{T_0}T_1 + \alpha E\varepsilon_1 \tag{2}$$

Using Eq. (2) and (1), $\dot{q}_2$ can be expressed in terms of $T_1$, $v_1$ and $\varepsilon_1$. The counterparts of these three quantities in frequency domain $\hat{T}$, $\hat{v}$, and $\hat{\varepsilon}$ can be extracted from the eigenfunctions of the eigenvalue problem. Under the assumption: $\beta/\omega \ll 1$, the second order cycle-averaged products $\langle a_1 b_1\rangle$ can be evaluated as $\langle a_1 b_1\rangle = \frac{1}{2}\mathrm{Re}[\hat{a}\hat{b}^*]e^{2\beta t}$ (e.g. $\langle s_1 v_1\rangle = \frac{1}{2}\mathrm{Re}[\hat{s}\hat{v}^*]e^{2\beta t}$), where a and b are dummy harmonic variable following the $e^{i\Lambda t}$ convention introduced previously, and the superscript * denotes the complex conjugate. We obtain $\langle\dot{q}_2\rangle = \tilde{Q}e^{2\beta t}$, where $$\tilde{Q} = \frac{1}{2}\rho_0 c_\epsilon \mathrm{Re}\left[\hat{T}\hat{v}^*\right] + \frac{1}{2}T_0\alpha E\mathrm{Re}[\hat{\varepsilon}\hat{v}^*]\left[\frac{W}{m^2}\right] \tag{3}$$

The total heat flux through the cross section of the rod is $$\dot{Q} = \int_A \langle\dot{q}_2\rangle dS = A\langle\dot{q}_2\rangle[W] \tag{4}$$

The second equality holds because the eigenfunctions are all cross-section-averaged quantities. We note that $\dot{Q}$ is a function of the axial position x.

The instantaneous mechanical power carried by the wave is defined as $$I_2 = (-\sigma_1)v_1 = \overline{\sigma}_1 v_1\left[\frac{W}{m^2}\right] \tag{5}$$

This quantity physically represents the rate per unit area at which work is done by an element onto its neighbor. It can be also called 'work flux' because it shows the work flow in the medium as well. When an element is compressed ($\overline{\sigma}>0$), it 'pushes' its neighbor so that a positive work is done on the adjacent element. A notable fact is that there is a directionality to $I_2$, which depends on the direction of $v_1$.

Similarly, the cycle-average mechanical power $\langle I_2\rangle$ can be expressed as $\langle I_2\rangle = \tilde{I}e^{2\beta t}$, where $$\tilde{I} = \frac{1}{2}\mathrm{Re}\left[\hat{\sigma}\hat{v}^*\right]\left[\frac{W}{m^2}\right] \tag{6}$$

The total mechanical power through the cross section I of the rod is given by $$I = \int_A \langle I_2\rangle dS = A\langle I_2\rangle[W] \tag{7}$$

The work source can be further defined as the gradient of the mechanical power as $$w_2 = \frac{\partial I_2}{\partial x}\left[\frac{W}{m^2}\right] \tag{8}$$

By expanding Eq. (8), $w_2$ can be further expressed as $$w_2 = \frac{\partial\overline{\sigma}_1}{\partial x}v_1 + \frac{\partial v_1}{\partial x}\overline{\sigma}_1 \tag{9}$$

The first term of $w_2$ vanishes after applying cycle-averaging, because according to the momentum conservation, $\partial\sigma_1/\partial x$ and $v_1$ are 90° out of phase under the assumption that the small phase difference caused by the non-zero $\beta$ can be neglected due to: $\beta/\omega \ll 1$. The remaining term is equivalent to $$\overline{\sigma}_1\frac{\partial\epsilon_1}{\partial t},$$

i.e.

$$\frac{\partial v_1}{\partial x}\overline{\sigma}_1 = \overline{\sigma}_1\frac{\partial\epsilon_1}{\partial t} \tag{10}$$

whose cycle average is consistent with the cycle-averaged volume change work.

The cross sectional integral of the work source is given by $$W = \int_A \langle w_2\rangle dS = A\langle w_2\rangle\left[\frac{W}{m}\right] \tag{11}$$

FIG. 10 shows the cycle-averaged quantities: heat flux $\tilde{Q}$ and mechanical power $\tilde{I}$ of a traveling wave engine ('Loop') and a standing wave one ('Res'). Note that the quantities indicated with $(\tilde{\ })$ satisfy the assumption of cycle averaging: $\langle(\ )_2\rangle = (\tilde{\ })\,e^{2\beta t}$. FIGS. 10(*a*) and 10(*c*) illustrate that heat flux only exists in the S-segment and that wave-induced transport of heat occurs from the hot to the cold heat exchanger. The negative values in the S-segment in (a) and (c) are due to the fact that the hot exchanger is on the right side of the cold one, so heat flows to the negative x direction in that case. The non-zero spatial gradient in $\tilde{Q}$ in the S-segment proves that there is heat exchange happening on the boundary of this segment because the heat flux in the axial direction is not balanced on its own.

FIG. 10(*d*) shows the mechanical power in the standing wave engine. The positive slope of $\tilde{I}$ in the S-segment elucidates the fact that the work generated in this region is positive, as discussed above. This amount of work drops along the axial direction in the remaining segments at the spatial rate of $d\tilde{I}/dx$. The work drop in the hot and cold segments balances the accumulation of energy because there is no radial energy exchange in these sections. Clearly, if there is no energy growth, the slope of $\tilde{I}$ should be zero in these sections, as also discussed above.

The work flow in the traveling wave engine, as FIG. 10(*b*) shows, has a very large value, which is due to the fact that negative stress $\overline{\sigma}$ and particle velocity v have a phase difference much smaller than 90° (FIG. 9). This means that a nearly uniform work flow is circulating the 'Loop' carried by the wave dominated by TWC. Contrarily to the standing wave case, the slope of $\tilde{I}$ is negative in the S-segment, because it is balancing the positive work created by $\tilde{I}$ against the temperature gradient in the TBS. The volumetric integration of the work source w, i.e. the spatial integration of W along the rod, should be zero because, globally, their is no energy output in the system. All the energy converted from the heat in the S-segment should eventually lead to a uniformly distributed perturbation energy growth. More discussions will be addressed in the following paragraphs.

To derive the acoustic energy budgets, we recast certain equations discussed in the previous example in the time domain:

$$\frac{\partial v_1}{\partial t} = -\frac{1}{\rho}\frac{\partial \overline{\sigma}_1}{\partial x}, \tag{12}$$

$$\frac{\partial \overline{\sigma}_1}{\partial x} = -E(1+\alpha\Upsilon_G T_0)\frac{\partial v_1}{\partial t} - \alpha E\frac{dT_0}{dx}v_1 + \frac{\alpha E}{R\rho c_\varepsilon}q_1, \tag{13}$$

where, $$q_1 = 2\kappa\frac{\partial T_1}{\partial r}\bigg|_{r=R}$$

indicates the conductive heat flux at the medium-stage interface. Multiplying Eq. (12) by $\rho v_1$ and Eq. (13) by $\overline{\sigma}_1 E^{-1}(1+\alpha\gamma_G T_0)^{-1}$, and adding them gives $$\frac{\partial \mathcal{E}_2}{\partial t} + \frac{\partial I_2}{\partial x} + \mathcal{R}_2 = \mathcal{P}_2 - \mathcal{D}_2 \tag{14}$$

where $$\mathcal{E}_2 = \frac{1}{2}\rho v_1^2 + \frac{1}{2}\frac{1}{E(1+\alpha\Upsilon_G T_0)}\overline{\sigma}_1^2 \tag{15}$$

$$I_2 = \overline{\sigma}_1 v_1 \tag{16}$$

$$\mathcal{R}_2 = \frac{\alpha}{1+\alpha\Upsilon_G T_0}\frac{dT_0}{dx}I_2 \tag{17}$$

$$\mathcal{P}_2 - \mathcal{D}_2 = \frac{\alpha}{1+\alpha\Upsilon_G T_0}\frac{1}{R\rho c_\varepsilon}q_1\overline{q}_1 \tag{18}$$

$\varepsilon_2$, $I_2$, $\mathcal{R}_2$, $\mathcal{P}_2$, and $\mathcal{D}_2$ are the second order energy norm, work flux, energy redistribution term, thermoacoustic production and dissipation, respectively. Note that the work flux shown in Eq. (16) is consistent with the heuristic definition adopted. With the harmonic convention $(\ )_1 = e^{(\beta+iw)t}(\hat{\ })$ and the assumption $\beta/\omega \ll 1$, taking the cycle averaging of Eq. (14) yields $$2\beta\tilde{\mathcal{E}} + \frac{d\tilde{I}}{dx} + \tilde{\mathcal{R}} = \tilde{\mathcal{P}} - \tilde{\mathcal{D}} \tag{19}$$

Where $\tilde{\varepsilon}$, $\tilde{I}$, $\tilde{\mathcal{R}}$, $\tilde{\mathcal{P}}$, and $\tilde{\mathcal{D}}$ are transformed from the cycle averages of the cross-sectionally-averaged second order terms in Eqs. 15-18, following the assumption of cycle averaging: $\langle(\ )_2\rangle = e^{2\beta t}(\tilde{\ })$. They are expressed as:

$$\tilde{\mathcal{E}} = \frac{1}{2}\rho|\hat{v}|^2 + \frac{1}{2}\frac{1}{E(1+\alpha\Upsilon_G T_0)}|\hat{\overline{\sigma}}|^2 \ quad\left[\frac{w}{m^3}\right] \tag{20}$$

$$\tilde{I} = \frac{1}{2}\mathrm{Re}\left[\hat{\overline{\sigma}}\hat{v}^*\right]\left[\frac{w}{m^3}\right] \tag{21}$$

$$\tilde{\mathcal{R}} = \frac{1}{2}\frac{\alpha}{1+\alpha\Upsilon_G T_0}\frac{dT_0}{dx}\mathrm{Re}\left[\hat{\overline{\sigma}}\hat{v}^*\right]\left[\frac{w}{m^3}\right] \tag{22}$$

$$\tilde{\mathcal{P}} = \frac{1}{2}\frac{1}{1+\alpha\Upsilon_G T_0}\left\{\mathrm{Re}[g_k]\mathrm{Re}\left[\hat{\overline{\sigma}}(i\omega\hat{\varepsilon})^*\right] + \mathrm{Im}[g_k]\mathrm{Im}\left[\hat{\overline{\sigma}}(i\omega\varepsilon)^*\right]\right\}\left[\frac{w}{m^3}\right] \tag{23}$$

$$\tilde{\mathcal{D}} = \frac{\omega}{2}\frac{1}{E(1+\alpha\Upsilon_G T_0)}|\hat{\overline{\sigma}}|^2 \ \mathrm{m}[g_k]\left[\frac{w}{m^3}\right] \tag{24}$$

The growth rate can be recovered via:

$$\beta_{EB} = \frac{\tilde{\mathcal{P}} - \tilde{\mathcal{D}} - \left(\frac{\partial \tilde{I}}{\partial x} + \tilde{\mathcal{R}}\right)}{2\tilde{\mathcal{E}}} \tag{25}$$

Figure 11:
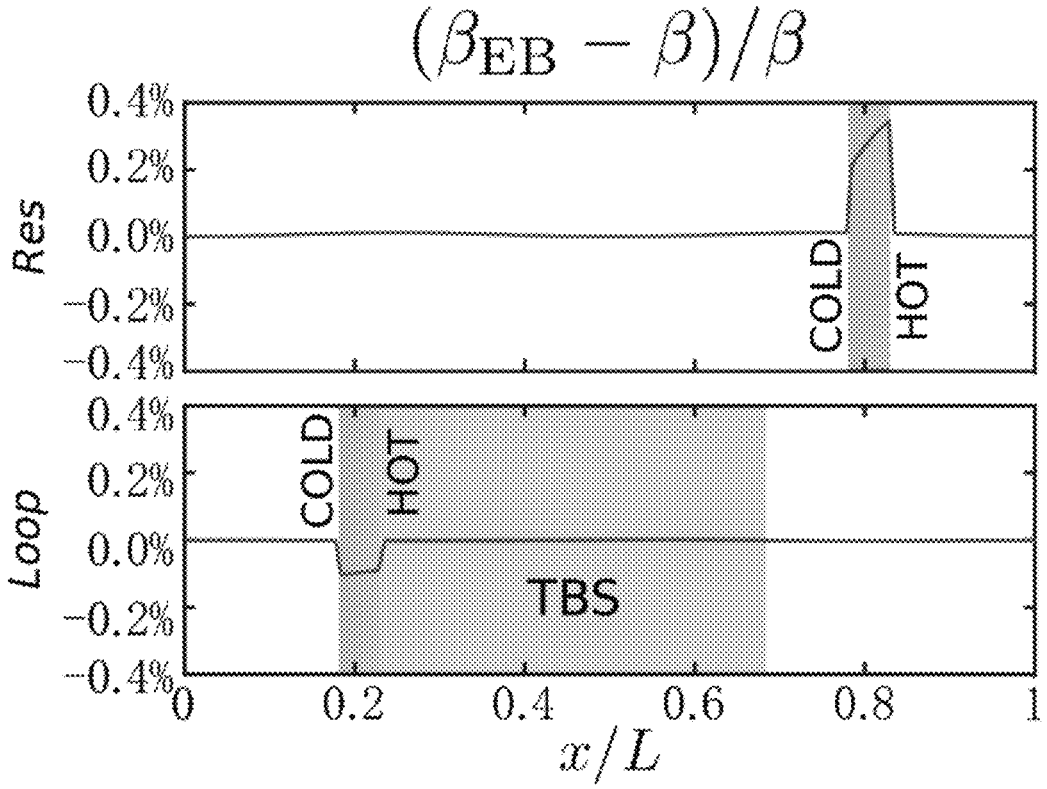
FIG. 11 illustrates relative difference of the growth rates estimates from energy budgets for the standing wave configuration and traveling wave configuration.
Figure 12A:
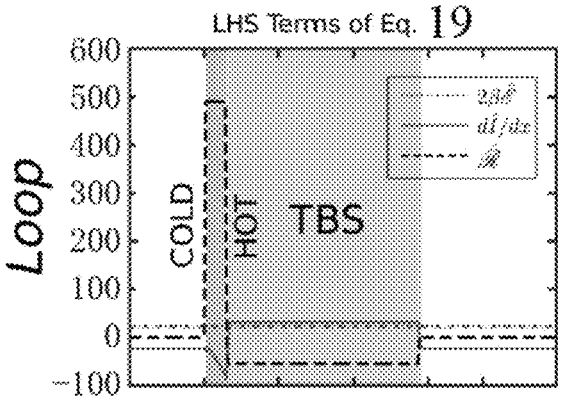
FIG. 12(*a*) illustrates an acoustic energy budget (LHS) for the traveling wave configuration.
Figure 12B:
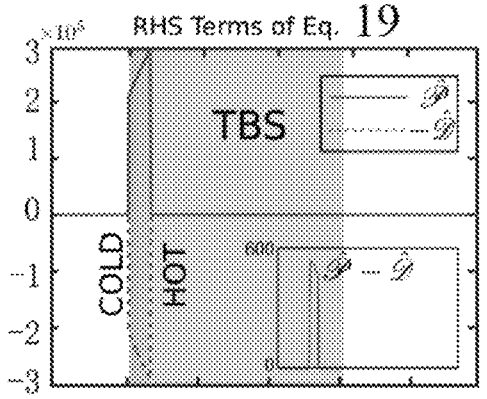
Figure 12C:
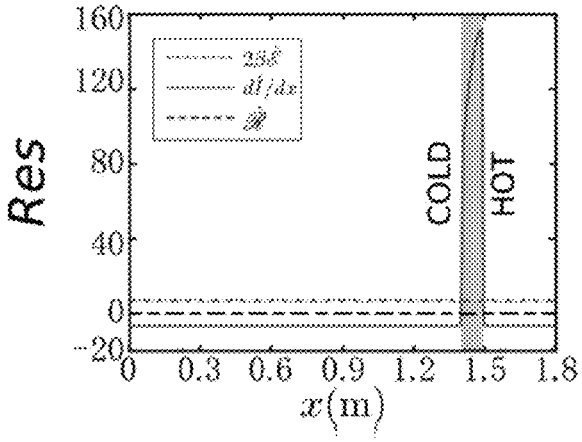
Figure 12D:
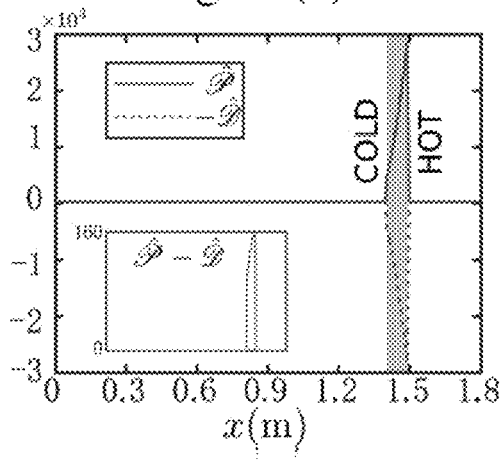

As FIG. 11 shows, the growth rates $\beta_{EB}$ calculated from Eq. (25) are within 0.4% from the direct output of the eigenvalue problem in both the standing wave and the traveling wave configurations, which validates the consistency of the derivations in this paragraph.

From the physical point of view, the significance of the terms in Eq. (19) are illustrated as following. $2\beta\tilde{\varepsilon}$ quantifies the rate of energy accumulation, $$\frac{\partial \tilde{I}}{\partial x}$$

is the work source defined in the previous paragraphs, $\tilde{\mathcal{R}}$ is an energy redistribution term. $\tilde{\mathcal{P}}$ and $\tilde{\mathcal{D}}$ are the thermoacoustic production and dissipation, respectively. The energy redistribution term in the acoustic energy budgets of solid thermoacoustics cannot be found in the fluid counterpart of the same equations. This term is absent in fluids because it is canceled in the algebraic derivations by expressing the variation of mean density according to the ideal gas law, as a function of the mean temperature gradient. On the other hand, in solidstate thermoacoustics, the heat-induced density variation is neglected and the impact of the temperature gradient is manifest in the stress-strain constitutive relation.

It has been proved numerically that the spatial integration of this term is zero, so it does not produce or dissipate energy, but just redistributes it. In summary, it represents the work created by the acoustic flux acting against the temperature gradient. FIG. 12 plots every term in the acoustic energy budgets (Eq. (19)) in the standing wave and traveling wave configurations, respectively.

The values of $\tilde{\mathcal{P}}$ and $\tilde{\mathcal{D}}$ are non-zero only in the S-segment. The dissipation $\tilde{\mathcal{D}}$ is due to wall heat transfer, which is a conductive loss. Although they are very similar in the S-segment, there exists a small difference between them. Thus, from a thermal standpoint, as a given amount of heat is transported through this section, a small portion of it (proportional to $\tilde{\mathcal{P}}-\tilde{\mathcal{D}}$) is converted into wave energy which accumulates in the rod, hence sustaining growth.

As can be seen, $2\beta\tilde{\varepsilon}$ is flat, meaning that the rate of the energy accumulation along the rod is uniform and exponential in time, consistent with the eigenvalue ansatz. In the standing wave configuration, the work flux gradient $$\frac{\partial \tilde{I}}{\partial x}$$

peaks in the S-segment, and has a constant negative value out of the S-segment. As foreshadowed by the discussions in the previous paragraph, this distribution means that $$\frac{\partial \tilde{I}}{\partial x}$$

adjusts itself so that β is uniform. In other words, energy is accumulated everywhere at the same rate.

Neglecting the small phase shift caused by β, the energy redistribution $\tilde{\mathcal{R}}$ does not exist in the standing wave configuration because of the 90° phase difference between $\hat{\sigma}$ and $\hat{v}$. Locally, the produced work in the S-segment, is converted from the most of the net production $\tilde{\mathcal{P}}-\tilde{\mathcal{D}}$. The remaining of $\tilde{\mathcal{P}}-\tilde{\mathcal{D}}$ transforms to the accumulated energy in this small segment. Outside the S-segment, the negative value of $$\frac{\partial \tilde{I}}{\partial x}$$

is exactly the same as the rate of the energy accumulation to keep the condition of zero local net production.

In the traveling wave configuration, the energy conversion becomes different because of the existence of the TBS. The TBS creates a temperature drop, which makes the energy redistribution term non zero in this section. To balance the negative value in the TBS, it peaks up in the S-segment so that the spatial integration is zero. In the TBS, the shape of the work flux gradient is the mirror image of that of the energy redistribution term because the addition of these two terms should be the negative of the spatially uniform energy accumulation rate. For the work flux gradient itself, a negative distribution in the S-segment is necessary to balance the positive redistributed work in the TBS so that the spatial integration is zero. The above supplements the explanations in the previous section on why the work source is negative in the S-segment.

Globally, in both configurations, given that both the spatial integrations of the work flux gradient and the energy redistribution terms are zero, the total net production $\int_0^L(\tilde{\mathcal{P}}-\tilde{\mathcal{D}})dx$ only leads to the accumulation of energy $$\int_0^L 2\beta\tilde{\mathcal{E}}dx = \int_0^L(\tilde{\mathcal{P}}-\tilde{\mathcal{D}})dx \tag{26}$$

Generally, efficiency is defined as the ratio of work done to thermal energy consumed. However, since there is no energy harvesting element in the system, the rod has no work output. Thus, we take the accumulated energy, which could be potentially converted to energy output, as the numerator of the ratio. For the denominator, limited to the 1D assumption, the thermal energy consumed is not available directly from the quasi-1D model because the evaluation of the radial heat conduction at the boundary is lacking. The heat flux $\dot{Q}$ could be considered as uniform for a short stack, which is approximately equal to the consumed thermal energy. Thus, we use the averaged $\dot{Q}$ over the S-segment, an estimate of the consumed thermal energy, as the denominator of the efficiency. As a result, the efficiency η is expressed as $$\eta = \frac{A\int_0^L \frac{\partial \mathcal{E}_2}{\partial t}dx}{\frac{1}{l_s}\int_{x_s-\frac{l_2}{2}}^{x_s+\frac{l_2}{2}}\dot{Q}dx} \tag{27}$$

$$= \frac{A\int_0^L 2\beta\tilde{\mathcal{E}}dx}{\frac{1}{l_s}\int_{x_s-\frac{l_2}{2}}^{x_s+\frac{l_2}{2}}\tilde{Q}dx} \tag{28}$$

Although this definition is the best estimate we could make based on the quasi-1D model, we highlight that fully nonlinear 3D simulations are capable of providing more accurate estimates of the efficiency.

Figure 13:
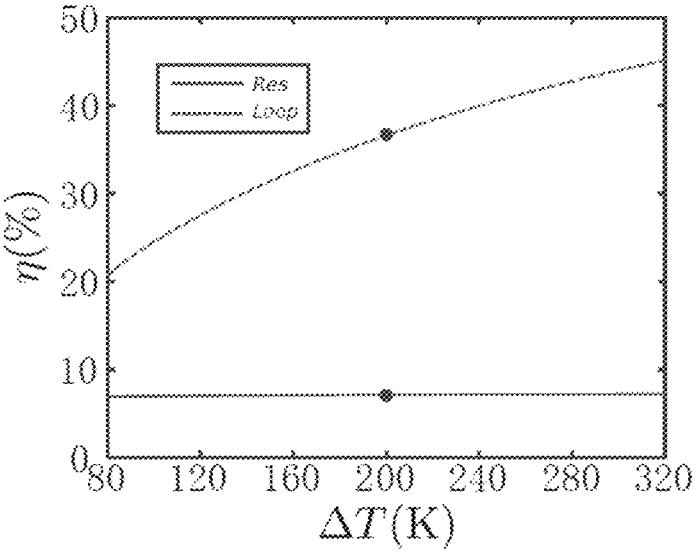
FIG. 13 illustrates efficiencies of the traveling wave configuration and the standing wave configuration at various temperature differences.

FIG. 13 shows the efficiencies of 'Loop' and 'Res' at different temperature difference $\Delta T=T_h-T_c$. It can be seen from this plot that (1) the efficiency of the traveling wave configuration 'Loop' is much higher than that of the standing wave configuration Res, which is consistent with the conclusions drawn in fluids, and (2) for the traveling wave configuration, the efficiency goes up with ΔT increasing, while for the standing wave one, the efficiency is insensitive to the change of ΔT. For the cases studied in the previous sections (ΔT=493.15K−293.15K=200K), the efficiencies η are 37% and 7% for 'Loop' and 'Res', respectively, as the dots show in FIG. 13.

Considering that the material properties of solids are much more tailorable than fluids, the efficiency of SSTA can be improved by designing an inhomogeneous medium having optimized mechanical and thermal thermoacoustic properties.

In this example, we have shown numerical evidence of the existence of traveling wave thermoacoustic oscillations in a looped solid rod. The growth ratio of a full wavelength traveling wave in a looped rod is found to be significantly larger than that of a full wavelength standing wave in a resonance rod. The phase delay in the looped rod between negative stress and particle velocity, which controls the value of TWC, is at most 30° under the situation that the stage is 5% L long and $\Delta T_0$=200K. Heat flux, mechanical power and work source are derived in analogous ways to their counterparts in fluids. The perturbation acoustic energy budgets are performed to interpret the energy conversion process of SSTA engines. The efficiency of SSTA engines is defined based on the rigorously derived energy budgets. The traveling wave SSTA engine is found to be more efficient than its standing wave counterpart. To conclude, this study confirms the theoretical existence of traveling wave thermoacoustics in a solid looped rod which could open the way to the next generation of highly-robust and ultracompact traveling wave thermoacoustic engines and refrigerators.

Example 3 one aspect of the present application relates to a thermoacoustic device includes a stage coupled to a bar, wherein the stage includes a first heating component on a first terminus of the stage. The stage further includes a first cooling component on a second terminus of the stage. A thermal conductivity of the stage is higher than a thermal conductivity of the bar. A heat capacity of the stage is higher than a heat capacity of the bar.

The bar comprises at least one of copper, iron, steel, lead, or a metal. In some embodiments, the bar comprises any solid. In some embodiments the bar is monolithic. The bar includes a material, wherein the material is not susceptible to oxidation at temperatures ranging from −100° C. to 2000° C., and wherein the material remains a solid at temperatures ranging from −100° C. to 2000° C.

In one or more embodiments, a first terminus of the bar is fixed, and a second terminus of the bar is free. The second terminus of the bar includes a solid mass, wherein a density of the solid mass is greater than a density of the bar. In at least one embodiment, a first terminus of the bar is fixed, and a second terminus of the bar is fixed. In some embodiments, a first terminus of the bar is fixed, and a second terminus of the bar is attached to a spring, wherein the spring is fixed.

In various embodiments, a first terminus and a second terminus of the bar are free from constraints. A temperature gradient between the first heating component and the first cooling component is 10° C./cm or higher. In some embodiments, a temperature gradient between the first heating component and the first cooling component is 20° C./cm or higher.

The thermoacoustic device further includes at least one additional stage coupled to the bar, wherein the at least one additional stage includes a second heating component and a second cooling component. In at least one embodiment, a temperature gradient between the second heating component and the second cooling component of the at least one additional stage is 10° C./cm or higher. In some embodiments, a temperature gradient between the second heating component and the second cooling of the at least one additional stage is 20° C./cm or higher.

The thermoacoustic device further includes a piezoelectric material coupled to the bar. The first cooling component includes at least one of a thermoelectric cooler, dry ice, or liquid nitrogen.

Example 4

Another aspect of the present application relates to a thermoacoustic device including a stage coupled to a bar, wherein the stage includes a first heating component on a first terminus of the stage. Additionally, the stage includes a first cooling component on a second terminus of the stage. A thermal conductivity of the stage is higher than a thermal conductivity of the bar. A heat capacity of the stage is higher than a heat capacity of the bar, and the bar forms a closed loop. Moreover, the thermoacoustic device includes a second cooling component on the bar, wherein the second cooling component is configured to cool to a same temperature as the first cooling component.

Example 5

Still another aspect of the present application relates to a thermoacoustic device including a stage coupled to a bar, wherein the stage includes a first heating component on a first terminus of the stage. Additionally, the stage includes a first cooling component on a second terminus of the stage. A thermal conductivity of the stage is higher than a thermal conductivity of the bar. A heat capacity of the stage is higher than a heat capacity of the bar. Moreover, the bar includes a material wherein the material does not oxidize at temperatures ranging from −100° C. to 2000° C. Further, the material remains a solid at temperatures ranging from −100° C. to 2000° C.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, design, machine, manufacture, and composition of matter, means, methods and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

The invention claimed is:

1. A thermoacoustic device comprising:

a stage coupled to a bar; and a piezoelectric material coupled to the bar, wherein the stage comprises:

a first heating component on a first terminus of the stage; and a first cooling component on a second terminus of the stage;

wherein a thermal conductivity of the stage is higher than a thermal conductivity of the bar, wherein a heat capacity of the stage is higher than a heat capacity of the bar.

2. The thermoacoustic device of claim 1, wherein the bar comprises at least one of copper, iron, steel, lead, or a metal.

3. The thermoacoustic device of claim 1, wherein the bar comprises any solid.

4. The thermoacoustic device of claim 1, wherein the bar is monolithic.

5. The thermoacoustic device of claim 1, wherein the bar comprises a material, wherein the material is not susceptible to oxidation at temperatures ranging from −100° C. to 2000° C., and wherein the material remains a solid at temperatures ranging from −100° C. to 2000° C.

6. The thermoacoustic device of claim 1, wherein a first terminus of the bar is fixed, and a second terminus of the bar is free.

7. The thermoacoustic device of claim 6, wherein the second terminus of the bar comprises a solid mass, wherein a density of the solid mass is greater than a density of the bar.

8. The thermoacoustic device of claim 1, wherein a first terminus of the bar is fixed, and a second terminus of the bar is fixed.

9. The thermoacoustic device of claim 1, wherein a first terminus of the bar is fixed, and a second terminus of the bar is attached to a spring, wherein the spring is fixed.

10. The thermoacoustic device of claim 1, wherein a first terminus and a second terminus of the bar are free from constraints.

11. The thermoacoustic device of claim 1, wherein a temperature gradient between the first heating component and the first cooling component is 10° C./cm or higher.

12. The thermoacoustic device of claim 1, wherein a temperature gradient between the first heating component and the first cooling component is 20° C./cm or higher.

13. The thermoacoustic device of claim 1, further comprising at least one additional stage coupled to the bar, wherein the at least one additional stage comprises a second heating component and a second cooling component.

14. The thermoacoustic device of claim 13, wherein a temperature gradient between the second heating component and the second cooling component of the at least one additional stage is 10° C./cm or higher.

15. The thermoacoustic device of claim 13, wherein a temperature gradient between the second heating component and the second cooling of the at least one additional stage is 20° C./cm or higher.

16. The thermoacoustic device of claim 1, wherein the first cooling component comprises at least one of a thermoelectric cooler, dry ice, or liquid nitrogen.

17. A thermoacoustic device comprising:

a stage coupled to a bar, wherein the stage comprises:

a first heating component on a first terminus of the stage; and a first cooling component on a second terminus of the stage;

wherein a thermal conductivity of the stage is higher than a thermal conductivity of the bar, wherein a heat capacity of the stage is higher than a heat capacity of the bar, wherein a first terminus of the bar is fixed, and a second terminus of the bar is free or attached to a spring.

18. The thermoacoustic device of claim 17, wherein the second terminus of the bar comprises a solid mass, wherein a density of the solid mass is greater than a density of the bar.

19. A thermoacoustic device comprising:

a stage coupled to a bar, wherein the stage comprises:

a first heating component on a first terminus of the stage; and a first cooling component on a second terminus of the stage;

wherein a thermal conductivity of the stage is higher than a thermal conductivity of the bar, wherein a heat capacity of the stage is higher than a heat capacity of the bar, wherein a first terminus and a second terminus of the bar are free from constraints.

* * * * *